US012660976B2

(12) United States Patent
Qian et al.

(10) Patent No.: US 12,660,976 B2
(45) Date of Patent: Jun. 23, 2026

(54) BASE STATION AND ROBOT CLEANER SYSTEM

(71) Applicant: Positec Power Tools (Suzhou) Co., Ltd., Suzhou (CN)

(72) Inventors: Fu Qian, Suzhou (CN); Shisong Zhang, Suzhou (CN); Hongfeng Zhong, Suzhou (CN)

(73) Assignee: Positec Power Tools (Suzhou) Co., LTD., Suzhou (CN)

( * ) Notice: Subject to any disclaimer, the term of this patent is extended or adjusted under 35 U.S.C. 154(b) by 364 days.

(21) Appl. No.: 18/231,663

(22) Filed: Aug. 8, 2023

(65) Prior Publication Data

US 2023/0389769 A1 Dec. 7, 2023

Related U.S. Application Data

(63) Continuation of application No. PCT/CN2022/075840, filed on Feb. 10, 2022.

(30) Foreign Application Priority Data

Feb. 10, 2021 (CN) ..... 202110182763.2

(51) Int. Cl.
*A47L 11/40* (2006.01)
*A47L 9/00* (2006.01)
(Continued)

(52) U.S. Cl.
CPC ..... *A47L 11/4091* (2013.01); *A47L 9/0063* (2013.01); *A47L 9/149* (2013.01);
(Continued)

(58) Field of Classification Search
CPC .... A47L 11/4091; A47L 9/0063; A47L 9/149; A47L 9/2805; A47L 9/2873; A47L 11/28;
(Continued)

(56) References Cited

U.S. PATENT DOCUMENTS 8,756,751 B2 * 6/2014 Jung ..... A47L 9/2805 15/319
9,717,388 B2 * 8/2017 Jeong ..... A47L 11/4036
(Continued)

FOREIGN PATENT DOCUMENTS

CN 107088025 8/2017
CN 111000497 A 4/2020
(Continued)

OTHER PUBLICATIONS

WO-2021004546-A1—English Machine Translation (Year: 2021).*
(Continued)

*Primary Examiner* — Marc Carlson
(74) *Attorney, Agent, or Firm* — Lee & Hayes, P.C.

(57) ABSTRACT

The disclosure provides a base station for a robot cleaner to park, the base station including a storage module configured to store a wiping substrate, a collection bin configured to store a dirty wiping substrate, a wiper replacement module configured to convey the dirty wiping substrate to the collection bin, and a drawing module configured to draw out dirt stored in a dust box.

18 Claims, 20 Drawing Sheets

(51) Int. Cl.
*A47L 9/14* (2006.01)
*A47L 9/28* (2006.01)
*A47L 11/28* (2006.01)

(52) U.S. Cl.
CPC ..... *A47L 9/2805* (2013.01); *A47L 9/2873* (2013.01); *A47L 11/28* (2013.01); *A47L 11/4011* (2013.01); *A47L 11/4025* (2013.01); *A47L 11/4036* (2013.01); *A47L 11/408* (2013.01); *A47L 2201/022* (2013.01); *A47L 2201/024* (2013.01); *A47L 2201/026* (2013.01); *A47L 2201/028* (2013.01); *A47L 2201/04* (2013.01)

(58) Field of Classification Search
CPC ..... A47L 11/4011; A47L 11/4025; A47L 11/4036; A47L 11/408; A47L 2201/022; A47L 2201/024; A47L 2201/026; A47L 2201/028; A47L 2201/04
See application file for complete search history.

(56) References Cited

U.S. PATENT DOCUMENTS

| | | | | |
|---|---|---|---|---|
| 10,730,397 | B2 * | 8/2020 | Romanov | B60L 15/20 |
| 11,690,493 | B2 * | 7/2023 | Weis | A47L 11/4036 15/98 |
| 12,329,337 | B2 * | 6/2025 | Xie | A47L 11/4011 |
| 2020/0077858 | A1 * | 3/2020 | Zhang | A47L 11/4019 |
| 2022/0061612 | A1 * | 3/2022 | Wolff | A47L 9/2805 |
| 2022/0211241 | A1 * | 7/2022 | Zheng | A47L 11/4011 |
| 2023/0271334 | A1 * | 8/2023 | Kim | A47L 13/16 |
| 2024/0041290 | A1 * | 2/2024 | Seo | A47L 11/4091 |

FOREIGN PATENT DOCUMENTS

| | | | | | |
|---|---|---|---|---|---|
| CN | 111345751 | A | | 6/2020 | |
| CN | 111920349 | | | 11/2020 | |
| CN | 111920349 | A | * | 11/2020 | A47L 11/4013 |
| CN | 212118053 | U | * | 12/2020 | |
| CN | 113040652 | | | 6/2021 | |
| CN | 216147953 | | | 4/2022 | |
| CN | 218500623 | U | | 2/2023 | |
| JP | 202036899 | A | | 3/2020 | |
| JP | 2022-532088 | A | | 7/2022 | |
| WO | WO-2020125774 | A1 | * | 6/2020 | A47L 11/4091 |
| WO | WO-2020224542 | A1 | * | 11/2020 | A47L 11/4091 |
| WO | 2021004546 | | | 1/2021 | |
| WO | WO-2021004546 | A1 | * | 1/2021 | A47L 11/20 |

OTHER PUBLICATIONS

European search opinion in application No. EP22752330.5, dated Apr. 14, 2025, 4 pages.
International Search Report in application No. PCT/CN2022/075840 dated Apr. 26, 2022, 3 pages.
Notice of Reasons for Refusal in application No. JP2023-548291 dated May 7, 2024, 4 pages.
Supplementary European search report in application No. EP22752330.5, dated Apr. 14, 2025, 2 pages.
Written opinion in application No. PCTCN2022075840 dated Apr. 26, 2022, 3 pages.
Machine translated Chinese First Office Action for related Chinese Patent Application No. 202280010654.5, dated Jan. 31, 2026, 11 pages.
Machine translated Chinese Search Report for related Chinese Patent Application No. 202280010654.5, dated Jan. 31, 2026, 2 pages.

* cited by examiner

BASE STATION AND ROBOT CLEANER SYSTEM

This application is a Continuation Bypass of International Application No. PCT/CN2022/075840 filed on Feb. 10, 2022, which claims the benefit of Chinese Patent Application No. 202110182763.2 filed on Feb. 10, 2021, the contents of which are hereby incorporated by reference herein in their entirety.

BACKGROUND

Technical Field

The disclosure relates to a base station and a robot cleaning system, in particular to a robot cleaning system capable of automatically replacing wipers and maintaining a dust box.

Related Art

With the development of technology and people's constant pursuit of higher quality of life, household robot cleaners, including but not limited to sweepers, mopping machines and window cleaners, are becoming more and more popular among users because they can help people free themselves from heavy housework.

Generally, a robot cleaner uses a vacuum device for a dust collection operation and a wiper (e.g. a paper towel, non-woven fabric, woven fabric, etc.) for a cleaning operation. The robot cleaner collects garbage and dirt, especially solid garbage, on the working surface while traveling along the set route, and drives the wiper to move on the working surface (e.g., wood floor, tile floor, etc.), thereby realizing the cleaning operation. Inevitably, as the cleaning operation proceeds, the garbage gradually fills the dust box in the vacuum device, and more and more dirt is attached to the wiper, making the cleaning effect worse. Therefore, the user has to manually remove the dust box to clean up the garbage and replace the dirty wiper with a clean wiper.

The existing robot cleaner usually requires manual cleaning of the dust box and manual replacement of the wiper. The user needs to keep an eye on the vacuuming and cleaning process to clean the dust box and replace the dirty wiper in time. This requires human intervention to manually clean the dust box and replace the wiper, and the user may get dirty hands when cleaning the dust box and replacing the wiper, causing poor user experience.

At present, there are base stations in the market that automatically clean wipers or replace wiping plates and automatically collect dust, but functional modules in the base station still need to be maintained manually, so the layout of the functional modules needs to be more convenient for users to operate. Moreover, these base stations are all large in size, occupy a large space, and do not have an attractive appearance.

SUMMARY

In order to solve the problems in the prior art, the disclosure provides a base station capable of automatically collecting dust and replacing a wiper for a robot cleaner without user intervention in a normal working process.

In order to solve the problems in the prior art, a technical solution adopted by the disclosure is as follows:

Provided is a base station, configured to maintain a robot cleaner. The base station includes: a shell, provided with a mounting space and a parking space for the robot cleaner to park; a wiper replacement module, configured to replace a wiper for the robot cleaner and including a collection bin and a storage bin arranged in the mounting space, the collection bin being configured to receive a dirty wiper, and the storage bin being configured to store a new wiper; the wiper being connected to the robot cleaner and configured to wipe a working surface where the robot cleaner travels; and a garbage collection module, including a dust collection bin and a fan arranged in the mounting space, the fan in communication with the dust collection bin to generate negative pressure in the dust collection bin to draw out garbage stored in the robot cleaner, and the dust collection bin being configured to store the garbage.

Functional modules for realizing various functions of the base station are mounted in the mounting space, and the parking space is configured to park the robot cleaner such that the base station maintains the robot cleaner. The base station is capable of providing services of replacing the wiper and collecting the garbage for the robot cleaner, thereby reducing manual maintenance.

In one embodiment, the shell has an entrance/exit for at least part of a framework of the robot cleaner to enter or exit the parking space. With a direction where the entrance/exit is located as the front, the collection bin and the storage bin are located on a front side or an upper side of the mounting space when in a non-working state.

In one embodiment, the mounting space includes a first accommodating space and a second accommodating space. The second accommodating space is arranged above the first accommodating space. The collection bin and the storage bin are arranged in the first accommodating space, and the dust collection bin and the fan are arranged in the second accommodating space.

In one embodiment, the collection bin and the storage bin are located on a front side of the first accommodating space when the base station is in the non-working state.

In one embodiment, the collection bin and the storage bin are detachably connected to the shell. A front side of the first accommodating space has a first opening, and the collection bin and the storage bin are capable of being demounted from and mounted into the first accommodating space through the first opening.

In one embodiment, the dust collection bin is detachably arranged in the second accommodating space. A front side or an upper side of the second accommodating space has a second opening, and the dust collection bin is capable of being demounted from and mounted into the second accommodating space through the second opening.

In one embodiment, the robot cleaner includes a wiping plate. The wiper is connected to the wiping plate. The wiper replacement module includes a lifting mechanism arranged at least in the parking space and the first accommodating space. The lifting mechanism drives the wiping plate to move between the parking space and the accommodating space to complete the replacement of the wiper on the wiping plate.

In one embodiment, in the non-working state, projections of the collection bin and the storage bin in a vertical direction at least partially overlap.

In one embodiment, the dust collection bin and the fan are at least partially located at a same height.

In one embodiment, the base station further includes a liquid adding module, configured to add a liquid to the robot cleaner. The liquid adding module includes a liquid tank configured to store a liquid to be added to the robot cleaner. The liquid tank is arranged in the second accommodating space.

In one embodiment, the dust collection bin, the fan and the liquid tank are at least partially located at a same height.

In one embodiment, the liquid tank is detachably arranged in the second accommodating space, an upper side of the second accommodating space further has a third opening, and the liquid tank is capable of being demounted from and mounted into the second accommodating space through the third opening.

In one embodiment, the base station further includes an interactive panel for interacting with a user. The interactive panel is located above the second accommodating space.

In one embodiment, the dust collection bin includes a dust collection bag. Projections of the dust collection bag and the fan in a vertical direction and a projection of the interactive panel in the vertical direction at least partially overlap.

In one embodiment, a projection of the liquid tank in a vertical direction and a projection of the interactive panel in the vertical direction do not overlap.

In one embodiment, the shell includes a front side wall, a rear side wall, an end cover connected to upper parts of the front side wall and the rear side wall, a bottom wall at least connected to a lower part of the rear side wall, and lateral side walls at least connected to the front side wall, the rear side wall and the end cover to form the mounting space and the parking space. The base station further includes a base station infrared sensor configured to be coupled with an infrared sensor on the robot cleaner so as to guide the robot cleaner to park at a maintenance position. The base station maintains the robot cleaner at the parking position, and the base station infrared sensor is arranged in the rear side wall.

In one embodiment, the garbage collection module further includes a dust collection tube in communication with the dust collection bin and configured to guide the garbage into the dust collection bin. The dust collection tube is at least partially arranged in the rear side wall.

In one embodiment, the garbage collection module further includes a docking port in communication with the dust collection tube. The docking port docks with the robot cleaner to draw the garbage stored in the robot cleaner, and the docking port is arranged in a middle region of the bottom wall.

In one embodiment, the liquid adding module further includes a liquid supply tube in communication with the liquid tank. The liquid supply tube is at least partially arranged in the rear side wall.

In one embodiment, the liquid adding module further includes a liquid outlet connected to a liquid outlet end of the liquid supply tube. The liquid outlet docks with the robot cleaner so as to add the liquid to the robot cleaner, and the liquid outlet is arranged on an outer surface of the rear side wall and movable with respect to the outer surface of the rear side wall.

In one embodiment, the base station includes a base station charging electrode configured to dock with a charging electrode of the robot cleaner so as to charge the robot cleaner. The base station charging electrode is arranged on an outer surface of the rear side wall.

In one embodiment, the end cover includes a flip structure. The flip structure is connected to the shell and the end cover such that the end cover flips with respect to the shell to open or close an upper side of the shell, and a projection of the flip structure on a surface where the bottom wall is located at least partially does not overlap the shell.

In order to solve the problems in the prior art, still another technical solution adopted by the disclosure is as follows:

Provided is a robot cleaner system, including a base station described above and a robot cleaner maintained using the base station.

In order to solve the problems in the prior art, still another technical solution adopted by the disclosure is as follows:

Provided is a base station for a robot cleaner to park. The robot cleaner includes a wiping plate. A flexible wiper is replaceably attached to the wiping plate to form a wiping surface so as to wipe a working surface where the robot cleaner travels. The robot cleaner further includes a dust box configured to collect garbage on the working surface where the robot cleaner travels. The base station includes: a storage module, configured to store a continuous wiping substrate; a collection bin, configured to store the wiper; a wiper replacement module, configured to convey the wiper to the collection bin, cut the wiping substrate into a wiper and mount the wiper to the wiping plate; and a garbage collection module, configured to draw out garbage stored in the dust box.

In one embodiment, the base station further includes a charging module, configured to charge the robot cleaner.

In one embodiment, the base station further includes a shell, configured to accommodate or partially accommodate the wiper replacement module and the garbage collection module. A front end of a lower part of the shell has an entrance/exit for at least part of a framework of the robot cleaner to enter an inside of the shell.

In one embodiment, the wiper replacement module includes a vertical conveying module configured to convey the wiping plate in a substantially vertical direction, a horizontal conveying module configured to convey the wiping plate in a substantially horizontal direction, an acquisition module configured to acquire and rotate the wiping plate, and a mounting module configured to mount the wiper to the wiping plate.

In one embodiment, the wiper replacement module further includes a feeding module, configured to transfer a free end of the wiping substrate to the mounting module and mount the wiper to a mounting position of the wiping plate.

In one embodiment, the garbage collection module includes a docking port for docking with a dust outlet of the dust box, an air inlet pipe connected to the docking port, a garbage bin connected to the air inlet pipe, an air outlet pipe connected to the garbage bin, and a fan connected to the air outlet pipe and configured to generate negative pressure to draw the garbage in the dust box.

In one embodiment, the air inlet pipe includes a horizontal air inlet pipe connected to the docking port and laid along the substantially horizontal direction, and a vertical air inlet pipe connected to the horizontal air inlet pipe and laid along the substantially vertical direction.

In one embodiment, the horizontal air inlet pipe and the vertical air inlet pipe are detachably connected.

In one embodiment, an upper end of the vertical air inlet pipe is detachably connected with a blocking structure.

In one embodiment, the base station further includes a water tank, configured to provide at least one of clean water or a cleaning liquid for the water tank of the robot cleaner.

In one embodiment, the wiper replacement module includes a wiping plate maintenance position for placing the wiping plate. The garbage collection module includes a docking port for docking with a dust outlet of the dust box. The docking port and the wiping plate maintenance position are arranged front and rear inside the shell. The docking port is closer to the entrance/exit of the base station than the wiping plate maintenance position.

In one embodiment, the collection bin is arranged at a front part in the shell, and the collection bin is arranged above the entrance/exit.

In order to solve the problems in the prior art, yet another technical solution adopted by the disclosure is as follows:

Provided is a robot cleaning system, including a robot cleaner and a base station for the robot cleaner to park. The robot cleaner includes: a main body; a moving module, mounted on the main body and driving the robot cleaner to move on a working surface; a wiping plate, mounted on the main body and configured to be detachably attached by a flexible wiper to form a wiping surface so as to wipe the working surface, the wiping plate including a loading part configured to mount the wiping plate to the main body; and a dust box, configured to collect garbage on the working surface where the robot cleaner travels. The base station includes: a storage module, configured to store a continuous wiping substrate; a collection bin, configured to store the wiper; a wiper replacement module, configured to convey the wiper to the collection bin, cut the wiping substrate into a wiper and mount the wiper to the wiping plate; and a garbage collection module, configured to draw out garbage stored in the dust box.

In one embodiment, the base station further includes a charging module, configured to charge the robot cleaner.

In one embodiment, the base station further includes a shell, configured to accommodate or partially accommodate the wiper replacement module and the garbage collection module. A front end of a lower part of the shell has an entrance/exit for at least part of a framework of the robot cleaner to enter an inside of the shell.

In one embodiment, the wiper replacement module includes a wiping plate maintenance position for placing the wiping plate. The garbage collection module includes a docking port for docking with a dust outlet of the dust box. The docking port and the wiping plate maintenance position are arranged front and rear inside the shell.

In one embodiment, the collection bin is arranged at a front part in the shell, and the collection bin is arranged above the entrance/exit.

In one embodiment, the garbage collection module further includes a docking port for docking with the dust outlet of the dust box, and a fan for generating negative pressure to draw out garbage in the dust box.

Compared with the prior art, the disclosure has the following beneficial effects: the base station continuously outputs the wiping substrate, and the wiper replacement module conveys the wiper on the wiping plate to the collection bin, cuts the wiping substrate into the wiper and mount the wiper to the wiping plate, so that the wiper of the robot cleaner can be replaced completely automatically in the base station. The garbage collection module draws out the garbage stored in the dust box of the robot cleaner, so that the dust box of the robot cleaner can be cleaned completely automatically in the base station. According to the solution, mopping maintenance and sweeping maintenance of the robot cleaner are integrated in one base station, thereby avoiding too large floor space and too high cost when using robot cleaners and base stations for respectively realizing the two functions.

BRIEF DESCRIPTION OF THE DRAWINGS

The above objects, technical solutions and beneficial effects of the disclosure may be realized by the following accompanying drawings.

DETAILED DESCRIPTION

Figure 1:
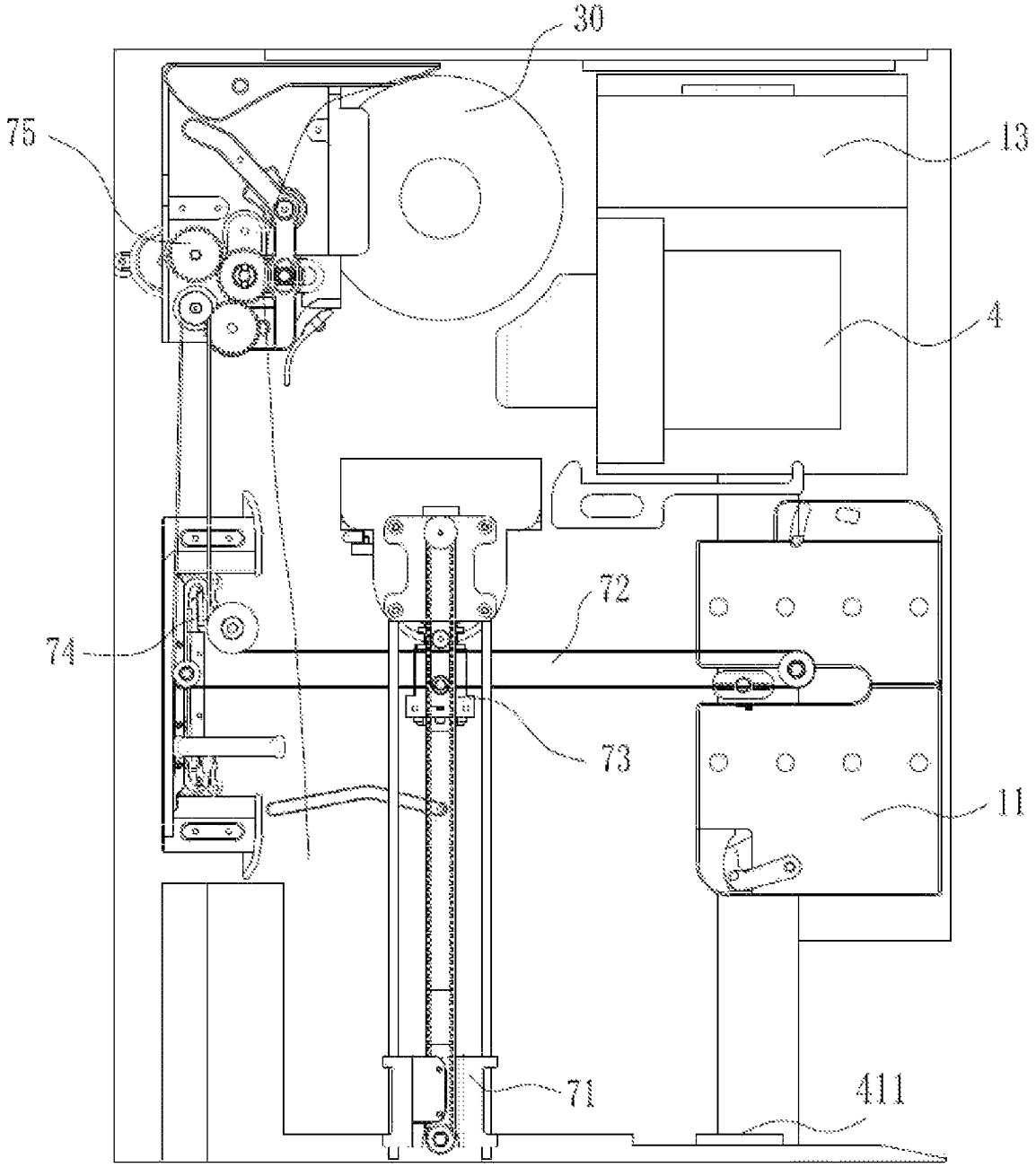
FIG. 1 is an internal structure view of a base station according to a first embodiment of the disclosure.

In order to make the objects, technical solutions and advantages of the disclosure more clear, the disclosure will be further described in detail below with reference to the accompanying drawings and implementations. It should be understood that the specific implementations described herein are merely illustrative of the disclosure and are not intended to limit the disclosure.

FIG. 1 to FIG. 6 show a base station 100 according to a first implementation of the disclosure, configured to park a robot cleaner 200. The robot cleaner 200 includes a main body 20 and a moving module 25. The moving module 25 is mounted on the main body 20, and drives the robot cleaner to move on a working surface. The robot cleaner 200 includes a wiping plate 24. A flexible wiper is replaceably attached to the wiping plate 24 to form a wiping surface so as to wipe the working surface where the robot cleaner 200 travels. The wiping plate 24 is detachably mounted to a bottom surface of the main body 20. The wiping plate 24 further includes a loading part configured to mount the wiping plate 24 to the main body 20. In one implementation, the loading part is a magnetic component. The bottom surface of the robot cleaner 200 is provided with a magnetic attraction member corresponding to the magnetic component. The magnetic component and the magnetic attraction member attract each other such that the wiping plate 24 is mounted to the main body 20. Of course, in other implementations, the loading part may also be another component that detachably assemblies the wiper onto the wiping plate 24. The robot cleaner 200 further includes a dust box, configured to collect garbage on the working surface where the robot cleaner 200 travels and release the garbage afterwards. The dust box includes a dust inlet and a dust outlet 22. During the working process of the robot cleaner 200, the dust outlet 22 is in a closed state. During the working process of the robot cleaner 200, in an advancing direction of the robot cleaner 200, a dust suction port 21 of the robot cleaner 200 is in front of the wiping plate 24, side brushes and a rolling brush are in front of the wiping plate 24, and the dust outlet 22 is arranged therebetween. When the robot cleaner 200 parks at the base station, one side of the wiping plate 24 is close to a rear part of the base station.

In one implementation, the robot cleaner 200 includes a detachment mechanism configured to detach the wiping plate 24 from the main body 20 and drop the wiping plate.

In other implementations, the robot cleaner 200 may be a robot cleaner having a single mopping function or a single sweeping function or both mopping and sweeping functions.

The base station 100 includes a shell 10, a storage module, a collection bin 11, a wiper replacement module and a garbage collection module. The shell 10 is configured to accommodate or partially accommodate the storage module, the collection bin 11, the wiper replacement module and the garbage collection module. A front end of a lower part of the shell 10 is provided with an entrance/exit for at least part of a framework of the robot cleaner 200 to enter an inside of the shell 10.

Figure 5:
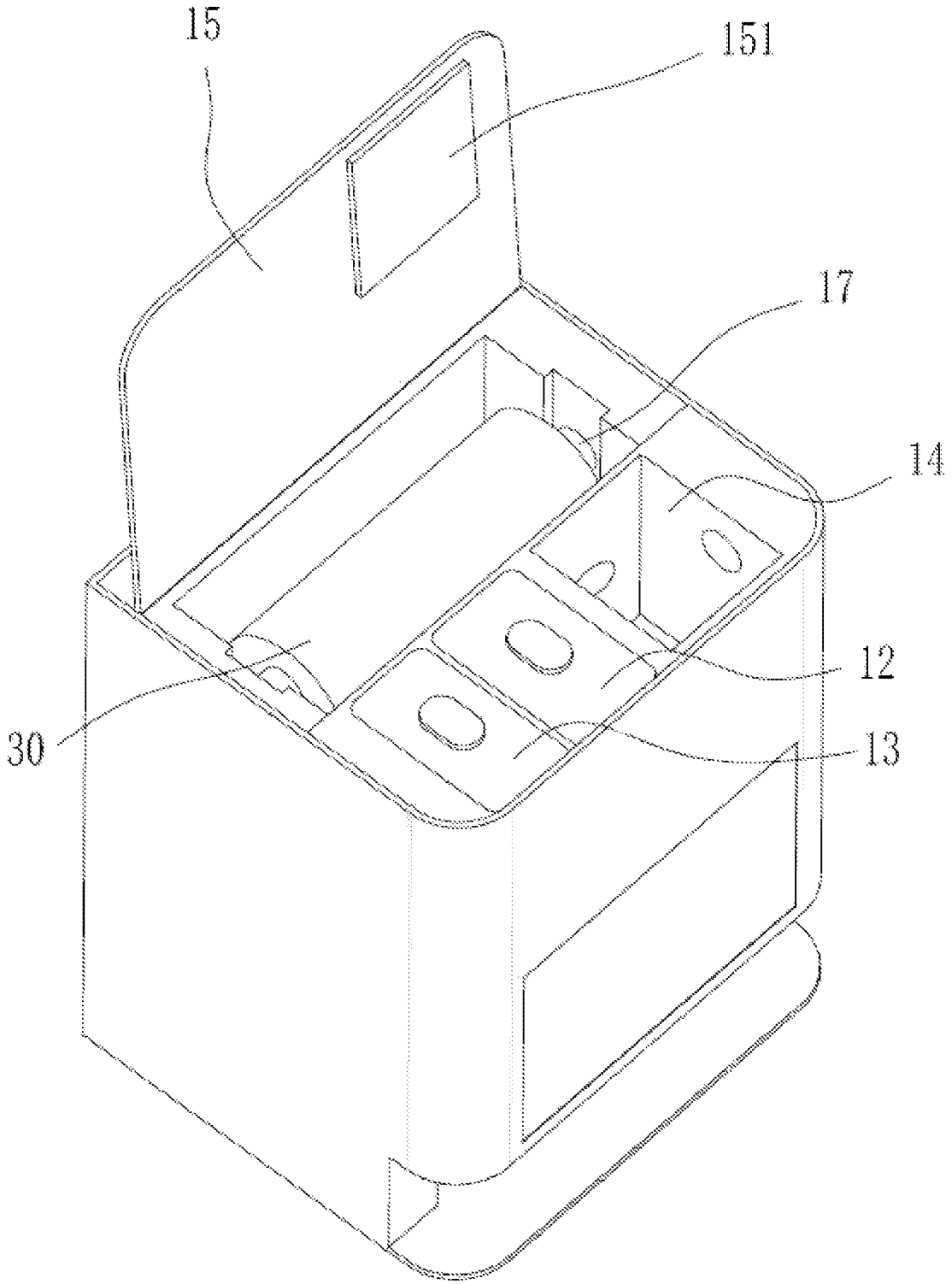
FIG. 5 is a schematic view of the base station with an upper end cover opened according to the first embodiment of the disclosure.

The storage module is configured to store a continuous wiping substrate 30. One end of the wiping substrate 30 is fixed to a rotating shaft, and starting with this end, the wiping substrate 30 is wound around the rotating shaft. A free end of the wiping substrate 30 is separated from a body of the wiping substrate 30 to form the wiper. As shown in FIG. 5, the storage module includes a mounting bracket 17. The mounting bracket 17 is mounted inside the shell 10. The mounting bracket 17 is matched with the rotating shaft around which the wiping substrate 30 is wound, so that the rotating shaft can be mounted on the mounting bracket 17.

Figure 6:
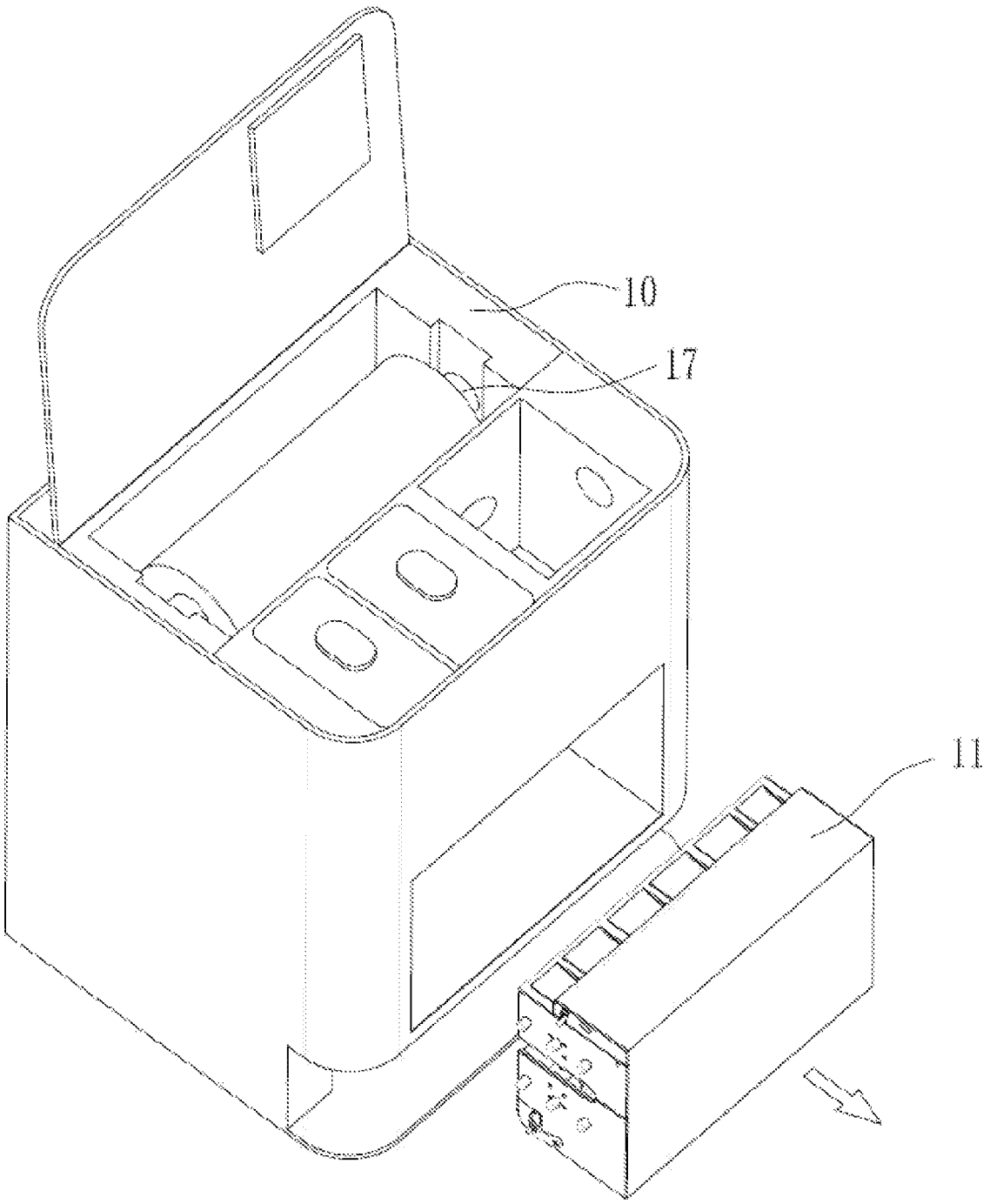
FIG. 6 is a schematic view of a collection bin of the base station in a removed state according to the first embodiment of the disclosure.

The collection bin 11 is configured to store the wiper, and especially the replaced dirty wiper. Optionally, as shown in FIG. 6, the collection bin 11 is arranged at a front part in the shell 10 and arranged above the entrance/exit, and can be taken out of the shell 10 so as to remove all the wipers in the collection bin 11 out of the base station 100. Optionally, a surface of the collection bin 11 exposing the shell 10 is provided with a door structure that can be opened by a user. The user may open the door structure so as to remove all the wipers in the collection bin 11 out of the base station 100.

The wiper replacement module is configured to convey the wiper to the collection bin 11, cut the wiping substrate 30 into a wiper and mount the wiper to the wiping plate 24, and includes a horizontal conveying module 72, a vertical conveying module 71, an acquisition module 73 and a mounting module 74.

One side of the robot cleaner 200 provided with the wiping plate 24 firstly enters the base station 100, and parks at the wiping plate maintenance position. The detachment mechanism detaches the wiping plate 24 with the wiper from the main body 20 and drops the wiping plate with the wiper on the vertical conveying module 71. Then, the robot cleaner at least partially moves away from the base station 100 to make room for the vertical conveying module 71. The wiping plate 24 with the wiper is placed at the wiping plate maintenance position. The vertical conveying module 71 drives the wiping plate 24 to move upward along the substantially vertical direction to a position substantially parallel to the collection bin 11. The acquisition module 73 acquires the wiping plate 24 with the wiper and drives the wiping plate 24 to rotate toward the collection bin 11. The horizontal conveying module 72 drives the acquisition module 73 and the wiping plate 24 to move toward the collection bin 11 along the substantially horizontal direction, leaving the wiper in the collection bin 11. The horizontal conveying module 72 drives the acquisition module 73 and the wiping plate 24 without the wiper to move toward the free end of the wiping substrate 30 along the substantially horizontal direction. The acquisition module 73 drives the wiping plate 24 to rotate toward the wiping substrate 30. In one implementation, the base station 100 includes a feeding module 75. The feeding module 75 transfers the free end of the wiping substrate to a mounting position. The mounting module 74 is configured to separate the wiping substrate 30 into a wiper and mount the wiper to the wiping plate 24. The horizontal conveying module 72 drives the acquisition module 73 and the wiping plate 24 with the new wiper to return to a position above the wiping plate maintenance position. The vertical conveying module 71 drives the wiping plate 24 with the new wiper to return to the wiping plate maintenance position. The robot cleaner 200 parks at the wiping plate maintenance position again and picks up the wiping plate 24.

In one implementation, the wiping substrate 30 is formed by connecting a plurality of wipers with a standard length, and there is a low connection strength between the wipers. For example, a dotted line is arranged between the wipers, so that there are weak connection points with a low connection strength between the wipers, and when the weak connection points are pulled from two sides, the wiper can be separated from the wiping substrate 30.

In one implementation, the feeding module 75 transfers the free end of the wiping substrate 30 to the mounting position and locks the wiping substrate 30 at one side of the weak connection points. While the wiping substrate 30 is mounted to the wiping plate 24, a pulling force is generated between the free end of the wiping substrate 30 and the wiping substrate 30, so that the body of the wiping substrate on one side of the weak connection points of the wiping substrate 30 is separated from the free end of the wiping substrate on the other side of the wiping substrate 30, thereby forming the wiper. Optionally, after the free end of the wiping substrate 30 reaches the mounting position, the mounting module 74 mounts the free end of the wiping substrate 30 to the wiping plate 24, the feeding module 75 is reversed, and the free end of the wiping substrate 30 is pulled from the body of the wiping substrate 30 along with the wiping plate 24, so as to be separated from the wiping substrate along the weak connection points.

The garbage collection module is configured to draw garbage stored in the dust box of the robot cleaner 200. In one implementation, the garbage collection module includes a docking port 411 for docking with the dust outlet 22 of the dust box, an air inlet pipe 41 in communication with the docking port 411, a garbage bin 14 in communication with the air inlet pipe 41, an air outlet pipe 42 in communication with the garbage bin 14, and a fan 4 in communication with the air outlet pipe 42 and generating negative pressure to draw out the garbage in the dust box. Preferably, an air outlet in the shell 10 corresponding to the fan 4 is provided with an air vent 16, and a disposable dust bag is arranged in the garbage bin 14, which may be, for example, a non-woven fabric bag with a filtering function. Of course, a detachable and cleanable dust box with a filtering function for filtering and collecting dust may also be arranged in the garbage bin. When the robot cleaner 200 returns to the base station 100, one side of the robot cleaner 200 provided with the wiping plate 24 firstly enters the base station 100 and parks at a drawing position. At this time, the dust outlet 22 of the dust box docks with the docking port 411 on the bottom of the base station 100, and the fan 4 starts working to draw the garbage in the dust box. Under the action of the negative pressure, the dust outlet 22 is opened, and the garbage enters the disposable dust bag in the garbage bin 14 through the air inlet pipe 41 and stays in the disposable dust bag.

Therefore, the robot cleaner 200 has at least two parking positions with respect to the base station 100, i.e., the wiping plate maintenance position and the drawing position. When the robot cleaner 200 parks at the wiping plate maintenance position, the wiping plate 24 docks with the vertical conveying module 71, and the handover of the wiping plate 24 is completed between the robot cleaner 200 and the vertical conveying module 71. When the robot cleaner 200 parks at the drawing position, the dust outlet 22 of the dust box docks with the docking port 411 on the bottom of the base station 100, thereby realizing drawing and dust collection. Preferably, the robot cleaner 200 parks at the same position to realize mounting and demounting of the wiping plate 24 and drawing of the garbage in the dust box. Further, the robot cleaner 200 parks at the same position to realize mounting and demounting of the wiping plate 24, drawing of garbage in the dust box, charging and automatic injection of water in the water tank of the base station into the water tank inside the robot cleaner 200.

Figure 3:
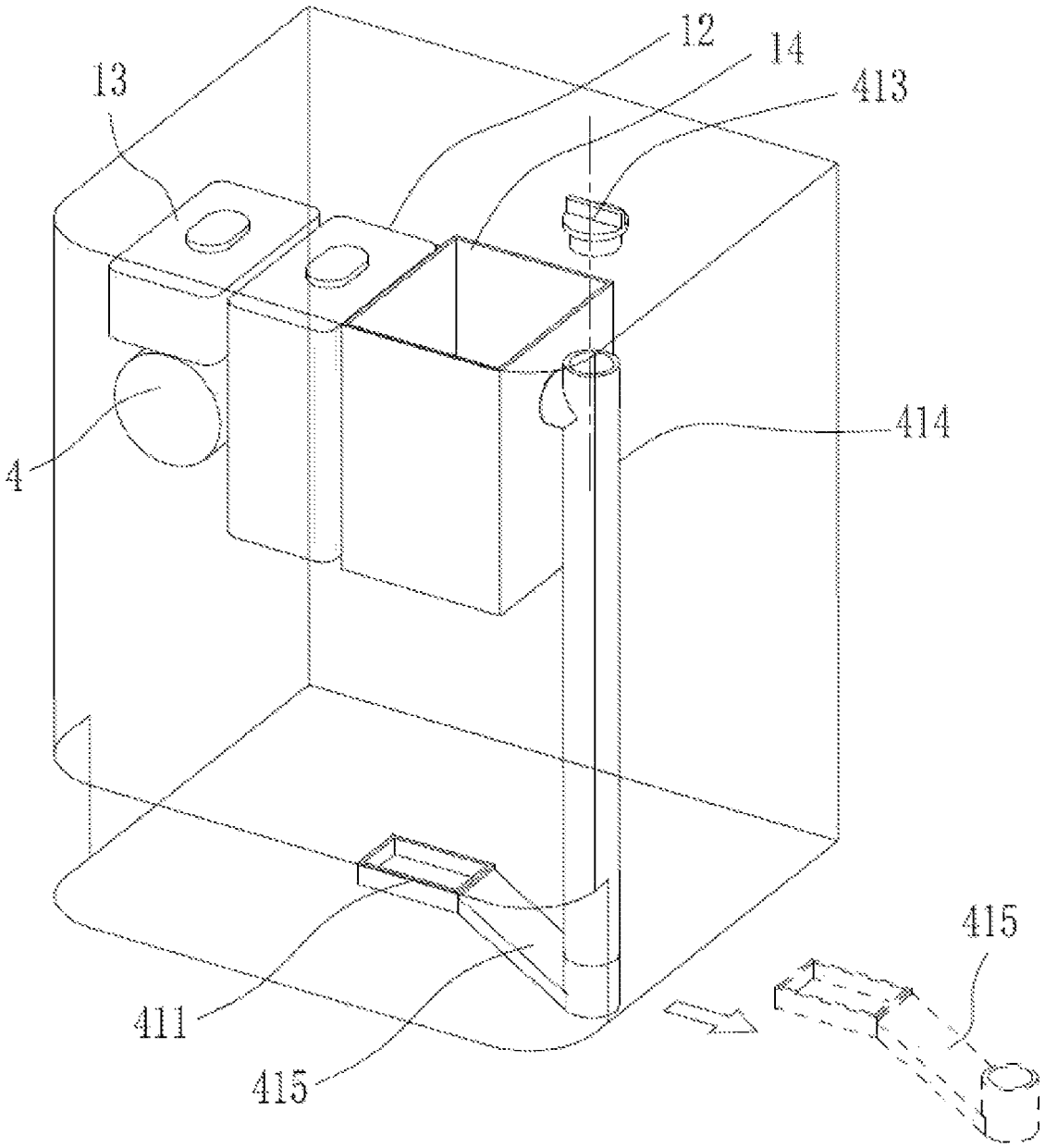
FIG. 3 is a schematic view of the base station with a detachable air inlet pipe according to the first embodiment of the disclosure.

In one implementation, the air inlet pipe 41 includes a horizontal air inlet pipe 415 and a vertical air inlet pipe 414. One end of the horizontal air inlet pipe 415 is connected to the docking port, and the horizontal air inlet pipe is laid along the substantially horizontal direction. The other end of the horizontal air inlet pipe is connected to the vertical air inlet pipe 414 that is laid along the substantially vertical direction. The other end of the vertical air inlet pipe 414 is connected to the garbage bin 14. Preferably, the vertical air inlet pipe 414 is attached to a left or right side wall in the shell 10, or a left and/or right side wall of the shell 10 has a certain thickness and the vertical air inlet pipe 414 is built in the left or right side wall. Preferably, as shown in FIG. 3, the horizontal air inlet pipe 415 and the vertical air inlet pipe 414 are detachably connected. The horizontal air inlet pipe 415 and/or the docking port 411 may be demounted from the inside of the shell 10. The other end of the vertical air inlet pipe 414 is respectively connected to the garbage bin 14 and detachably connected with a blocking structure 413. The blocking structure 413 may be demounted from the shell 10 along a direction including but not limited to a left-right direction and a front-rear direction. The demounting direction may also be not limited to the horizontal direction, and for example, the blocking structure may be demounted from the inside of the shell 10 along a substantially vertically upward direction, or demounted from the inside of the base station by ways of rotation. This detachable structure facilitates cleaning of the air inlet pipe 41 and prevents the air inlet pipe from being blocked. When the structures of the air inlet pipe 41 are connected, the whole air inlet pipe 41 is sealed so as to prevent the garbage from escaping via the joints.

In one implementation, the base station 100 further includes a water tank, a water pump and a water flow duct. The water tank includes a detergent tank 13 and a clean water tank 12, and is configured to inject clean water or a detergent into the water tank of the robot cleaner 200 through the water pump and the water flow duct. Of course, the water tank may also be a single water tank for only storing the detergent or the clean water.

In one implementation, an upper end of the shell 10 has an opening and is provided with an end cover 15 that can be opened upward. The wiping substrate, the water tank and the garbage bin 14 may be taken out and put in through the opening. An inner surface of the end cover 15 is provided with a sealing member 151, corresponding to an opening on an upper end of the garbage bin 14 and configured to seal the garbage bin 14.

Figure 2:
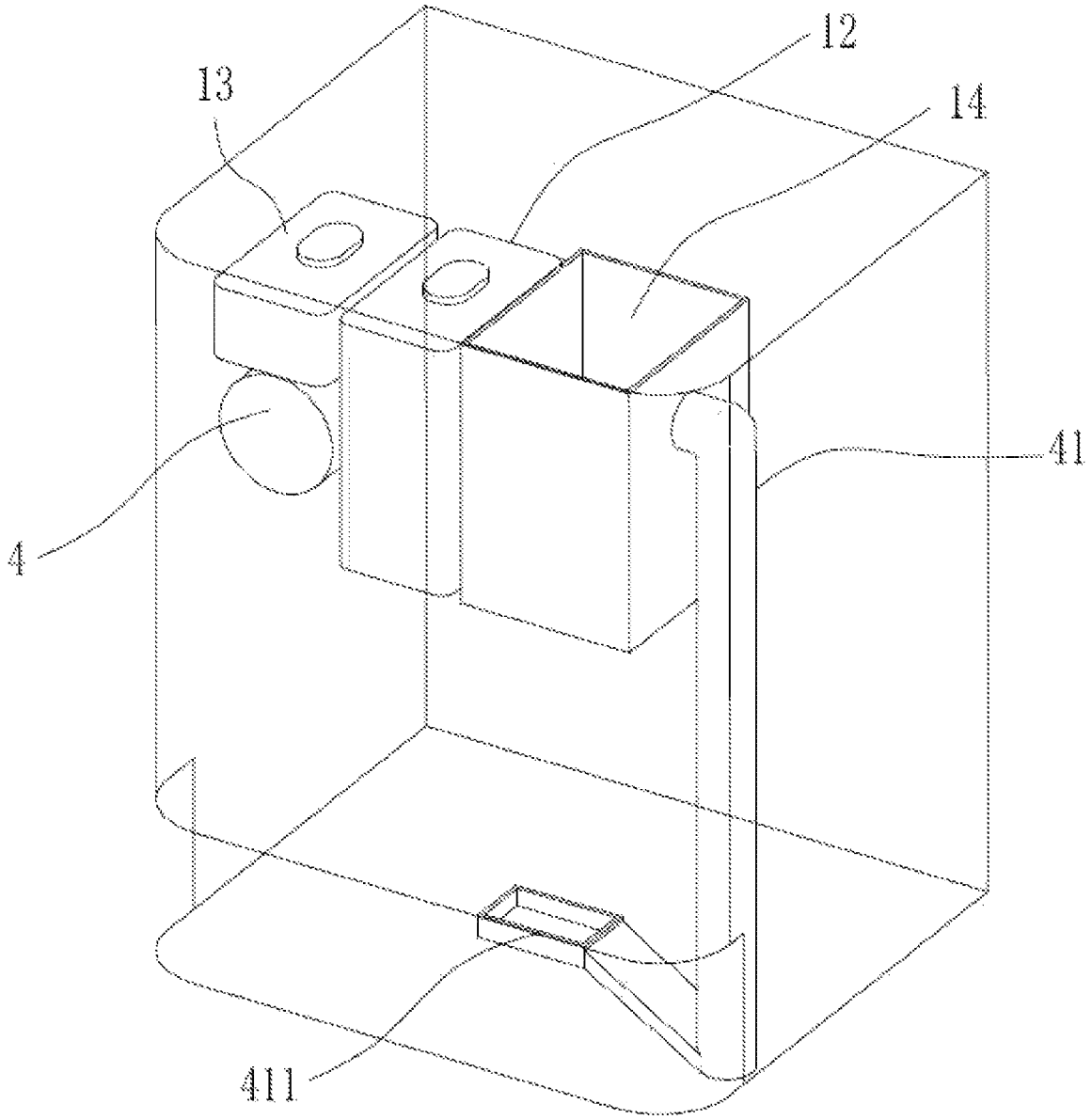
FIG. 2 is a schematic view of a garbage collection module of the base station from one viewing angle according to the first embodiment of the disclosure.
Figure 4:
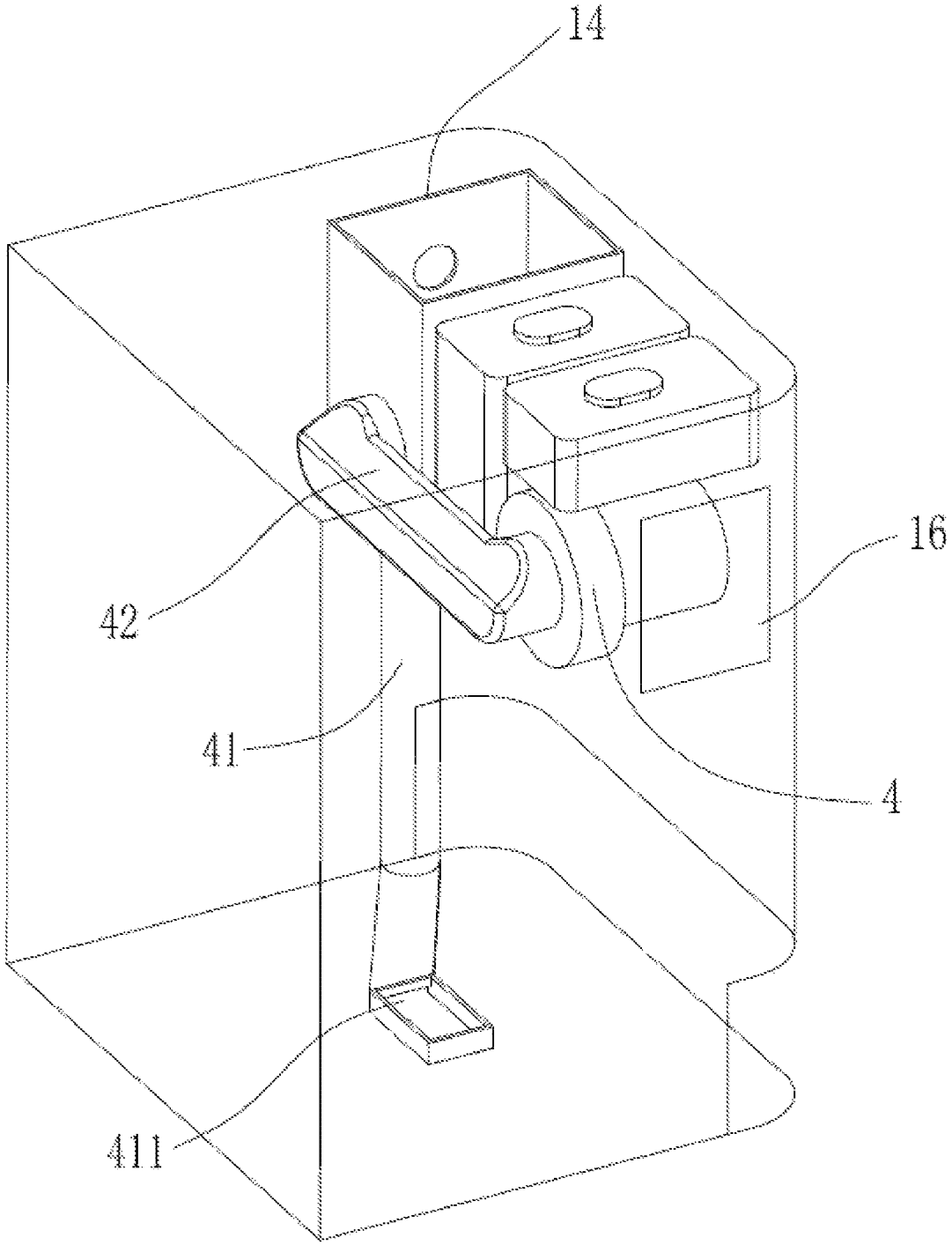
FIG. 4 is a schematic view of the garbage collection module shown in FIG. 2 from one viewing angle.

In one implementation, the docking port 411 and the wiping plate maintenance position where the wiping plate 24 is placed are sequentially arranged in a front-rear direction inside the shell 10. Specifically, with the entrance/exit as the front, as shown in FIG. 2, FIG. 3 and FIG. 4, the water tank and the garbage bin 14 are arranged above the collection bin 11. The water tank is substantially L-shaped. The fan 4 is arranged at a notch of the L-shaped water tank. The air outlet pipe 42 is arranged at the rear of the water tank in the substantially horizontal direction. The water tank, the fan 4 and the garbage bin 14 at least partially overlap respectively in the front-rear direction, the left-right direction and the vertical direction. Preferably, the water tank, the fan 4 and the garbage bin 14 are arranged at a same height, overlap in the front-rear direction, and are arranged side by side in the left-right direction. The vertical air inlet pipe 415 is arranged along a vertical edge inside the shell 10. As shown in FIG. 5 and FIG. 6, the storage module is arranged at the rear of the garbage bin 14 and the water tank, and the wiper replacement module is arranged below the storage module. This arrangement may make full use of the internal space of the shell 10, and make the internal structure of the shell 10 more compact and the base station 100 smaller in size.

In one implementation, the base station 100 further includes a charging module configured to charge the robot cleaner 200.

The base station 100 continuously outputs the wiping substrate 30, and the wiper replacement module conveys the wiper on the wiping plate 24 to the collection bin 11, cuts the wiping substrate 30 into a wiper and mount the wiper to the wiping plate 24, so that the wiper of the robot cleaner 200 can be replaced completely automatically in the base station 100. The garbage collection module draws out the garbage stored in the dust box of the robot cleaner 200, so that the dust box of the robot cleaner 200 can be cleaned completely automatically in the base station 100. According to the disclosure, mopping maintenance and sweeping maintenance of the robot cleaner 200 are integrated in one base station 100, thereby avoiding too large floor space and too high cost when using robot cleaners 200 and base stations 100 for respectively realizing the two functions.

On the basis of the existing robot cleaner automatically returning to the base station 100 for charging, in this solution, the robot cleaner 200 automatically returns to the base station 100 to replace the wiper and clean the dust box. Compared with the traditional robot cleaner, after the robot cleaner 200 vacuums and wipes the surface, there is no need for the user to replace the wiper and clean the dust box, or to have a lot of intervention on the base station 100 and the robot cleaner 200.

Figure 7:
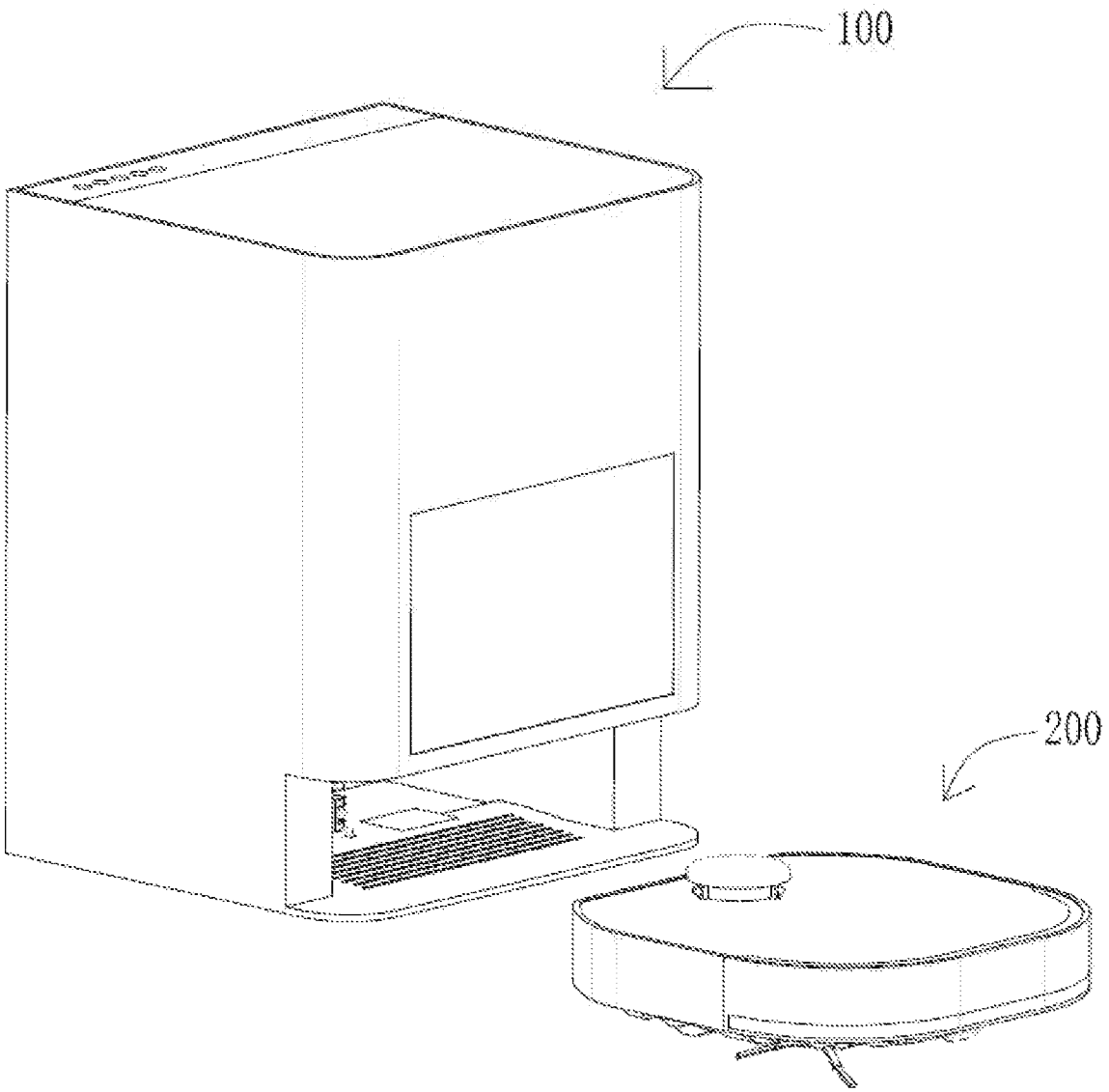
FIG. 7 is an external schematic view of a robot cleaning system according to the first embodiment of the disclosure.
Figure 8:
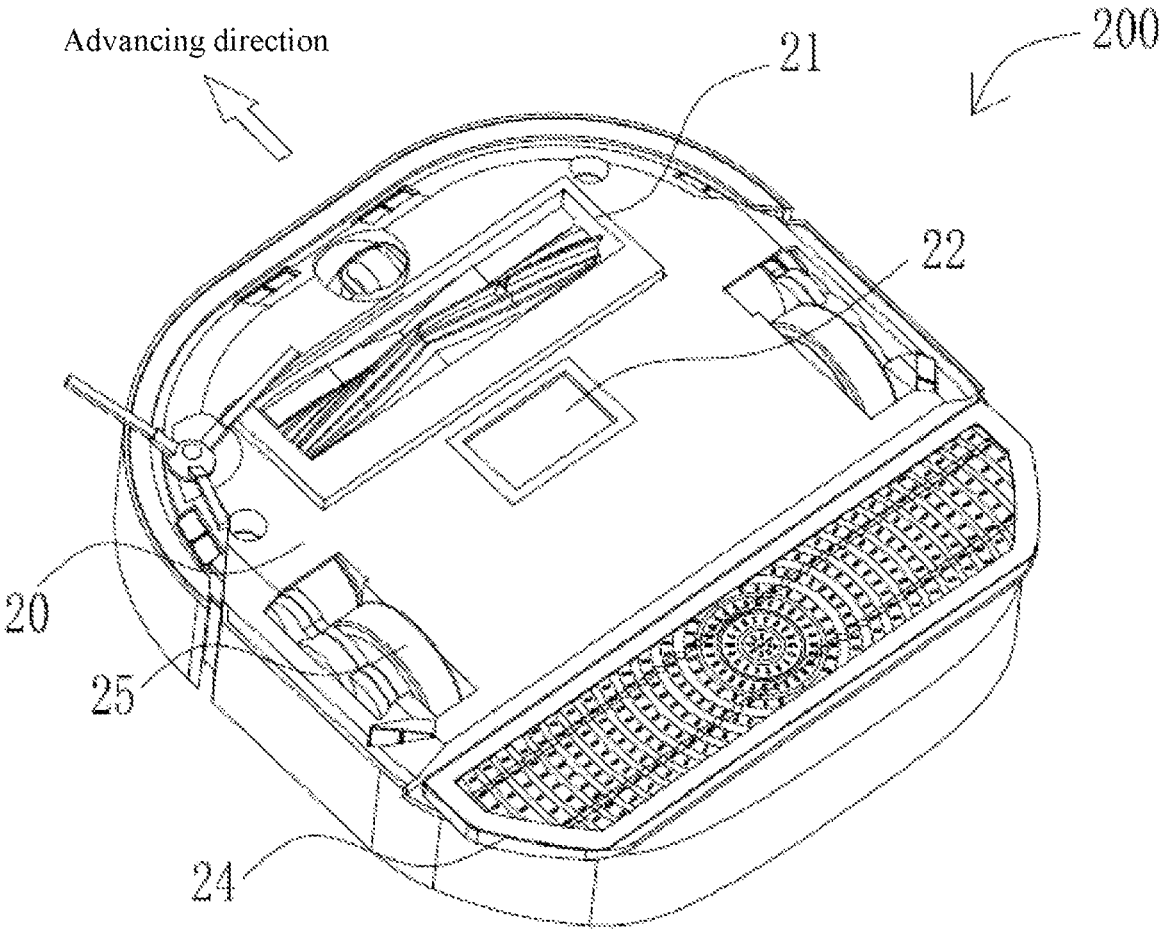
FIG. 8 is a schematic view of a bottom of a robot cleaner according to the first embodiment of the disclosure.

A robot cleaning system shown in FIG. 7 includes the robot cleaner 200 and the base station 100 for the robot cleaner 200 to park. In one implementation, at least part of the framework of the robot cleaner 200 enters the inside of the base station 100. The robot cleaner 200 may enter the base station 100 in such a way that the wiping plate 24 of the robot cleaner 200 is in front of the dust suction port 21. The wiping plate 24 is detached from the main body 20 and placed to the wiping plate maintenance position where the acquisition module 73 can acquire the wiping plate. The dust outlet 22 of the dust box docks with the docking port 411. In one implementation, while the wiping plate 24 of the robot cleaner 200 is placed to the wiping plate maintenance position, the dust outlet 22 of the dust box docks with the docking port 411. In other implementations, while the wiping plate 24 of the robot cleaner 200 is placed to the wiping plate maintenance position, the dust outlet 22 of the dust box does not dock with the docking port 411.

In other implementations, the robot cleaner 200 may be a robot cleaner with a single mopping function or a single sweeping function, or a robot cleaner having both mopping and sweeping functions. The base station 100 may also only realize the function of automatically replacing the wiper for the robot cleaner 200, or only realize the function of automatically cleaning the dust box for the robot cleaner 200, or realize the functions of both replacing the wiper and cleaning the dust box.

Figure 9:
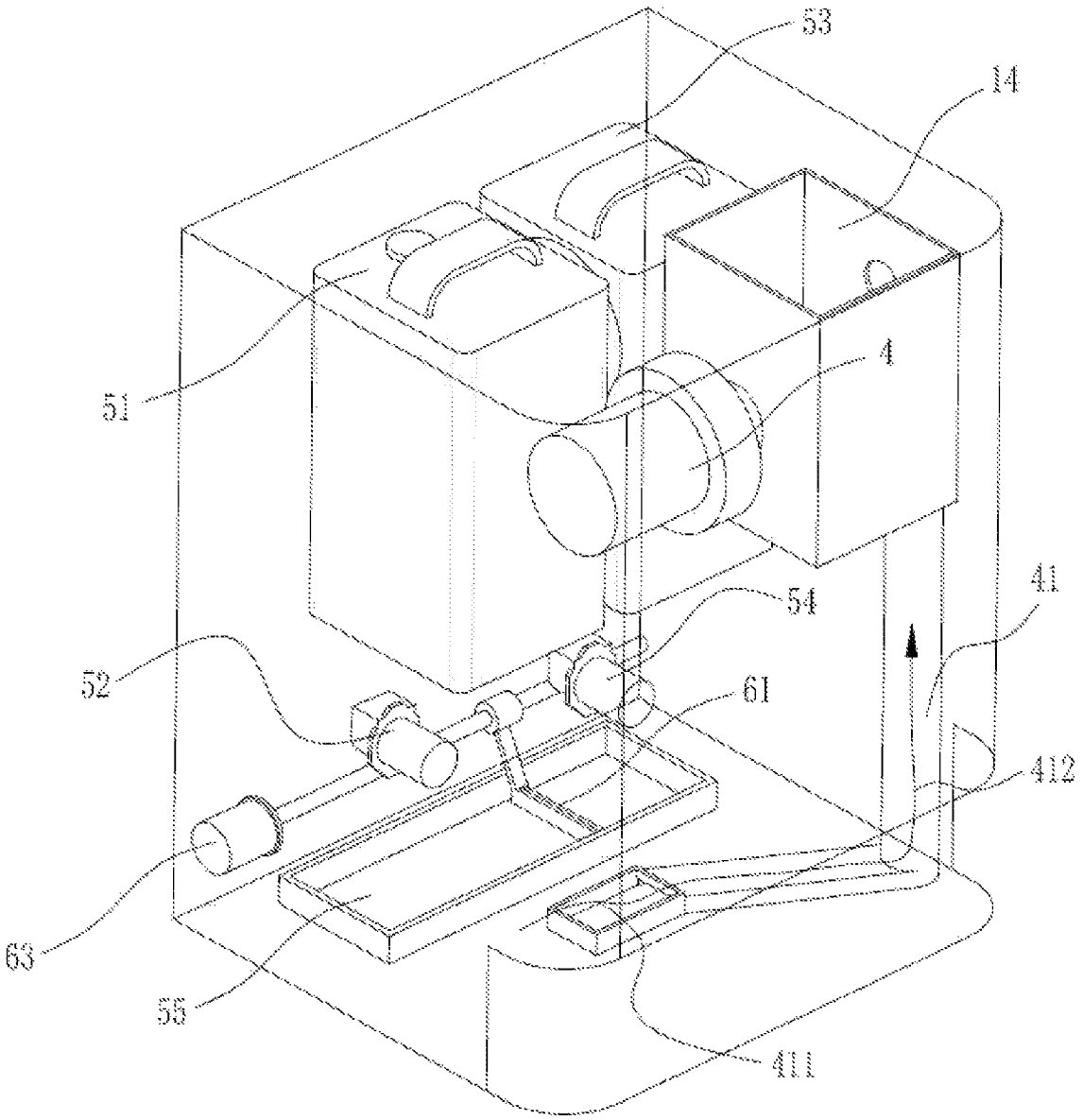
FIG. 9 is an internal structure view of a base station according to a second embodiment of the disclosure.
Figure 10:
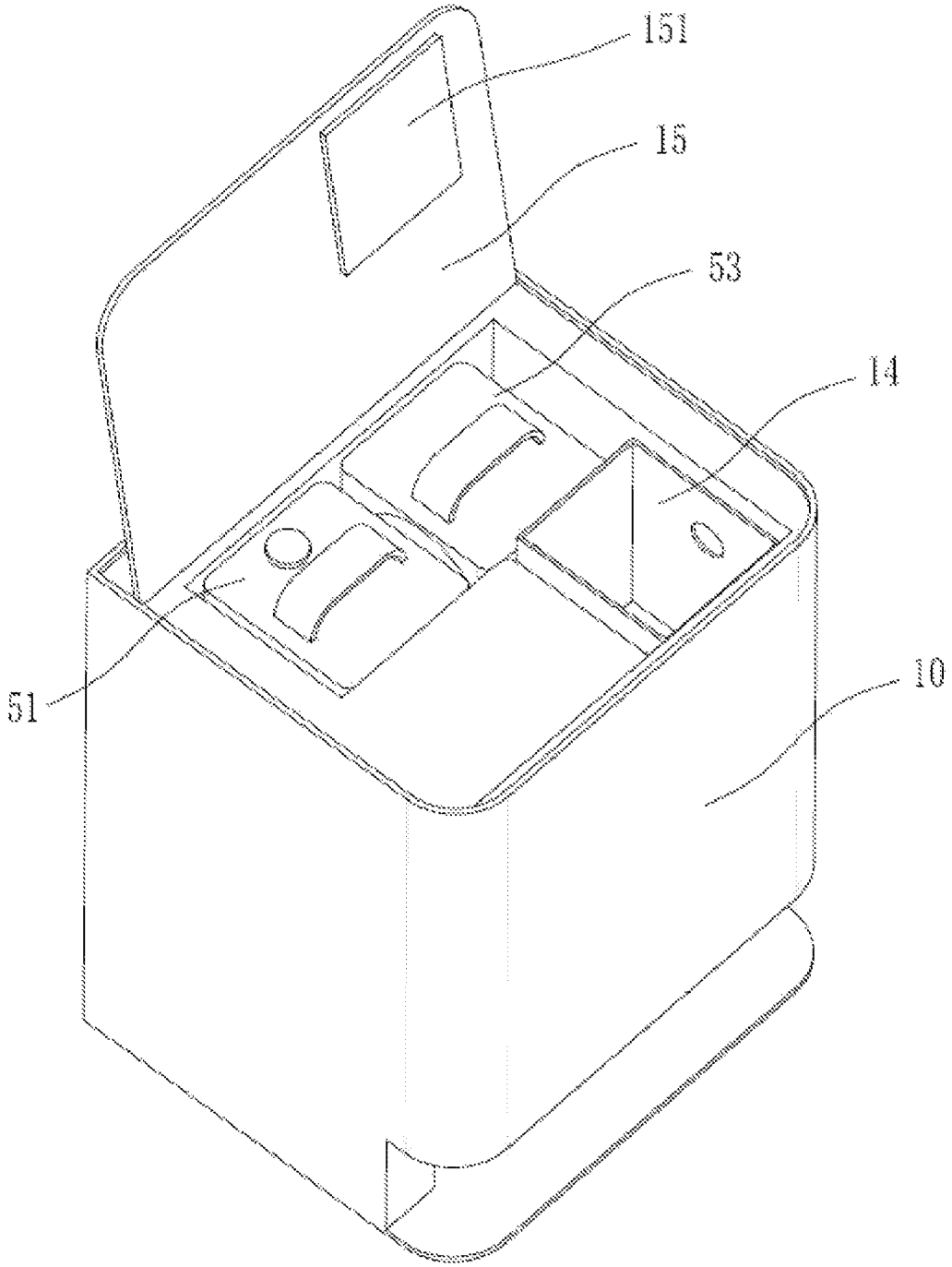
FIG. 10 is a schematic view of the base station with an upper end cover opened according to the second embodiment of the disclosure.

FIG. 9 and FIG. 10 show a base station 100 according to a second implementation of the disclosure, configured to park a robot cleaner 200. A wiper of the robot cleaner 200 is replaceably attached to a wiping plate 24. The wiper is cleanable. The other structures of the robot cleaner 200 are substantially the same as those of the robot cleaner in the first implementation, and details will not be repeated here.

The base station 100 includes a shell 10, a cleaning module and a garbage collection module. The shell 10 is configured to accommodate or partially accommodate the cleaning module and the garbage collection module. A front end of a lower part of the shell 10 is provided with an entrance/exit for at least part of a framework of the robot cleaner 200 to enter an inside of the shell 10.

The cleaning module is configured to clean the wiper on the wiping plate 24. As shown in FIG. 9, in one implementation, the cleaning module includes a cleaning pool 55, a clean water tank 51, a water injection pump 52, a cleaning unit, a dirty water tank 53 and a water pump 54. The cleaning pool 55 is configured to place the wiping plate 24 with the wiper. The water injection pump 52 is connected to the clean water tank 51 and configured to inject clean water in the clean water tank 51 into the cleaning pool 55 so as to clean the wiper. In one implementation, the cleaning unit includes a scraper 61 and a scraper drive motor 62. The scraper 61 is driven by the scraper drive motor 62 to move along a horizontal direction and act on the wiping plate 24 with the wiper in the cleaning pool 55, so as to remove dirt on the wiper. The water pump 54 is connected to the dirty water tank 53 and configured to move dirty water in the cleaning pool 55 into the dirty water tank 53.

The garbage collection module is configured to draw garbage stored in the dust box of the robot cleaner 200. As shown in FIG. 9, in one implementation, the garbage collection module includes a docking port 411 for docking with a dust outlet 22 of a dust box, an air inlet pipe 41 in communication with the docking port 411, a garbage bin 14 in communication with the air inlet pipe 41, an air outlet pipe 42 in communication with the garbage bin 14, and a fan 4 in communication with the air outlet pipe 42 and generating negative pressure to draw out the garbage in the dust box. Preferably, an air outlet in the shell 10 corresponding to the fan 4 is provided with an air vent (not shown), and a disposable dust bag is arranged in the garbage bin 14 and configured to filter and collect dust. When the fan 4 starts working to draw the garbage in the dust box, the dust outlet 22 is opened, and the garbage enters the disposable dust bag in the garbage bin 14 through the air inlet pipe 41 and stays in the disposable dust bag. An air flow 412 in the garbage collection module is shown in FIG. 9.

In one implementation, the air inlet pipe 41 includes a horizontal air inlet pipe and a vertical air inlet pipe. One end of the horizontal air inlet pipe is connected to the docking port, and the horizontal air inlet pipe is laid along the substantially horizontal direction. The other end of the horizontal air inlet pipe is connected to the vertical air inlet pipe that is laid along the substantially vertical direction. The other end of the vertical air inlet pipe is connected to the garbage bin 14. Preferably, the vertical air inlet pipe is attached to a left or right side wall in the shell 10, or a left and/or right side wall of the shell 10 has a certain thickness and the vertical air inlet pipe is built in the left or right side wall. Preferably, as shown in FIG. 3, the horizontal air inlet pipe and the vertical air inlet pipe are detachably connected. The horizontal air inlet pipe and/or the docking port 411 may be demounted from the inside of the shell 10. The other end of the vertical air inlet pipe is respectively connected to the garbage bin 14 and detachably connected with a blocking structure. The blocking structure may be demounted from the shell 10 along a direction including but not limited to a left-right direction and a front-rear direction. The demounting direction may also be not limited to the horizontal direction, and for example, the blocking structure may be demounted from the inside of the shell 10 along a substantially vertically upward direction, or demounted from the inside of the base station by ways of rotation. This detachable structure facilitates cleaning of the air inlet pipe 41 and prevents the air inlet pipe from being blocked. When the structures of the air inlet pipe 41 are connected, the whole air inlet pipe 41 is sealed so as to prevent the garbage from escaping via the joints.

In one implementation, as shown in FIG. 10, an upper end of the shell 10 has an opening and is provided with an end cover 15 that can be opened upward. The wiping substrate, the water tank and the garbage bin 14 may be taken out and put in through the opening. An inner surface of the end cover 15 is provided with a sealing member 151, corresponding to an opening on an upper end of the garbage bin 14 and configured to seal the garbage bin 14.

In one implementation, the docking port 411 and a cleaning pool 55 are sequentially arranged inside the shell 10 in the front-rear direction. Specifically, with the entrance/exit as the front, as shown in FIG. 9 and FIG. 10, a clean water tank 51 and a dirty water tank 53 are arranged above the clean water tank and located at a rear part inside the shell 10. The fan 4 and the garbage bin 14 are arranged above the docking port 411 and located at a front part inside the shell 10. The vertical air inlet pipe is arranged along a vertical edge inside the shell In one implementation, the base station 100 further includes a charging module configured to charge the robot cleaner 200.

The base station 100 cleans the wiper on the wiping plate 24 through the cleaning module. The garbage collection module draws out the garbage stored in the dust box of the robot cleaner 200, so that the wiper and the dust box of the robot cleaner 200 can be cleaned completely automatically in the base station 100. According to the disclosure, mopping maintenance and sweeping maintenance of the robot cleaner 200 are integrated in one base station 100, thereby avoiding too large floor space and too high cost when using robot cleaners and base stations for respectively realizing the two functions.

On the basis of the existing robot cleaner automatically returning to the base station for charging, in this solution, the robot cleaner 200 automatically returns to the base station 100 to clean the wiper and the dust box. Compared with the traditional robot cleaner, after the robot cleaner 200 vacuums and wipes the surface, there is no need for the user to clean the wiper and the dust box, or to have a lot of intervention on the base station 100 and the robot cleaner 200.

The robot cleaning system includes the robot cleaner 200 and the base station 100 for the robot cleaner 200 to park. In one implementation, at least part of the framework of the robot cleaner 200 enters the inside of the base station 100. The robot cleaner 200 may enter the base station 100 in such a way that the wiping plate 24 of the robot cleaner 200 is in front of the dust suction port 21. The robot cleaner 200 has at least two parking positions with respect to the base station 100, i.e., the wiping plate maintenance position and the drawing position. When the robot cleaner parks at the wiping plate maintenance position, the wiping plate 24 is substantially located above the cleaning pool 55. When the robot cleaner parks at the drawing position, the dust outlet 22 of the dust box docks with the docking port 411. In one implementation, the wiping plate maintenance position and the drawing position where the robot cleaner parks are the same position. That is, while the wiping plate 24 of the robot cleaner 200 is placed in the cleaning pool 55, the dust outlet 22 of the dust box docks with the docking port 411. In other implementations, while the wiping plate 24 of the robot cleaner 200 is placed in the cleaning pool 55, the dust outlet 22 of the dust box does not dock with the docking port 411.

In other implementations, the robot cleaner 200 may be a robot cleaner with a single mopping function or a single sweeping function. The base station 100 may also only realize the function of automatically cleaning the wiper for the robot cleaner 200, or only realize the function of automatically cleaning the dust box for the robot cleaner 200.

A robot cleaner system includes a robot cleaner 200 and a base station 100 for maintaining the robot cleaner 200. The robot cleaner 200 includes a sweeping module and a mopping module. The sweeping module is configured to sweep dust, particles and other garbage on a working surface where the robot cleaner 200 travels, and further includes a dust box configured to collect the garbage. The mopping module includes a wiping plate 24. A replaceable flexible wiper may be attached to the wiping plate 24 to form a wiping surface so as to wipe the working surface where the robot cleaner 200 travels. The base station 100 is configured to park and maintain the robot cleaner 200. The base station 100 includes a garbage collection module, a wiper replacement module, a collection bin 11 and a charging module. The garbage collection module includes a drawing unit, configured to draw out the garbage stored in the dust box and store the garbage in the garbage bin 14.

A storage unit of the wiper replacement module stores a wiping substrate formed by winding continuous and clean wipers.

The wiper replacement module separates the user wiper from the wiping plate 24 and collects the used wiper into the collection bin 11.

The wiper replacement module conveys the wiping substrate to a wiper replacement unit, cuts the wiping substrate into a wiper, and mounts the wiper to the wiping plate 24.

The charging module is configured to charge the robot cleaner 200.

The base station 100 includes an automatic water adding device, configured to automatically supply clean water to the robot cleaner 200.

The automatic water adding device includes a water pump, a water tank and a water flow duct.

The wiping plate 24 may be separated from or combined with a main body.

The base station 100 includes a shell 10, configured to accommodate or partially accommodate the wiper replacement module and the garbage collection module. The shell has a bin and a parking position where the robot cleaner 200 can park. The bin has an entrance/exit, and is located on a bottom of the shell 10. At least part of a framework of the robot cleaner 200 can automatically enter an inside of the shell 10 through the entrance/exit.

The robot cleaner 200 may park at least two parking positions, i.e., a wiping plate maintenance position and a drawing position. The wiping plate maintenance position and the drawing position are the same position.

The wiper replacement module includes the wiping plate maintenance position for placing the wiping plate 24 and the drawing position for drawing the garbage in the dust box. The garbage collection module includes a docking port 411 for docking with a dust outlet of the dust box, and the docking port 411 and the wiping plate maintenance position are arranged front and rear inside the shell 10.

The collection bin 11 is arranged above the entrance/exit. The collection bin 11 may be separated from the shell 10.

The water tank and the garbage bin 14 are arranged above the collection bin 11.

The water tank and the garbage bin 14 at least partially overlap in a height direction of the base station 100.

The water tank and the garbage bin 14 at least partially overlap in a left-right direction of the base station 100.

The water tank and the garbage bin 14 at least partially overlap in a front-rear direction of the base station 100.

The water tank, a fan 4 and the garbage bin 14 at least partially overlap in the height direction of the base station 100.

The water tank, the fan 4 and the garbage bin 14 at least partially overlap in the left-right direction of the base station 100.

The water tank, the fan 4 and the garbage bin 14 at least partially overlap in the front-rear direction of the base station 100.

The storage unit of the wiper replacement module and one of the water tank and the garbage bin 14 at least partially overlap in the left-right direction and/or the front-rear direction and/or the up-down direction of the base station 100.

The base station 100 has a top opening, and the water tank and the garbage bin 14 may be separated from the base station 100 through the top opening. The wiping substrate may be put into the base station 100 through the top opening.

The shell 10 further includes a bottom and a side wall. The docking port 411 is located on the bottom. The garbage collection module includes the fan 4 and an air flow channel. The fan 4 generates negative pressure to draw out the garbage in the dust box and collect the garbage into the garbage bin 14 through the air flow channel between the docking port 411 and the garbage bin 14.

The air flow channel includes an air inlet pipe, and the air inlet pipe extends to the left or right side wall via the bottom.

The robot cleaner 200 has at least two parking positions with respect to the base station 100, i.e., the wiping plate maintenance position and the drawing position. When the robot cleaner parks at the wiping plate maintenance position, the wiping plate 24 and/or the wiper is maintained. When the robot cleaner 200 parks at the drawing position, the dust outlet of the dust box docks with the docking port 411 on the bottom of the base station 100. The wiping plate maintenance position and the drawing position are the same position.

The robot cleaner 200 parks at the same position of the base station 100 to realize maintenance of the wiper, drawing of garbage in the dust box, charging and automatic injection of water in the water tank of the base station 100 into the water tank inside the robot cleaner 200.

The robot cleaner system includes the robot cleaner 200 and the base station 100 for maintaining the robot cleaner 200. The work flow includes: replacement of wiper: separating the wiping plate 24, replacing the wiper on the wiping plate 24, collecting the wiper, and mounting the wiper to the wiping plate 24; collecting the garbage inside the robot cleaner 200; injecting the water in the water tank inside the base station 100 into the water tank in the robot cleaner 200; and charging the robot cleaner.

According to the robot cleaner system, after the robot cleaner 200 completes a specified task, the base station 100 automatically performs the corresponding action. That is, after the robot cleaner completes sweeping, it returns to the base station 100 for garbage collection, which may be specifically by vacuuming. After the robot cleaner completes mopping, it returns to the base station 100 for wiper maintenance, which may be replacement of the wiper or cleaning of the wiper. After the robot cleaner completes sweeping and mopping, it returns to the base station 100 for garbage collection and wiper maintenance. The garbage collection and the wiper maintenance may be performed at the same time.

In one embodiment, referring to FIG. 11 to FIG. 14, provided is a base station 100, configured to maintain a robot cleaner 200. The base station 100 includes: a shell, provided with a mounting space S1 and a parking space S2 for the robot cleaner 200 to park; a wiper replacement module, configured to replace a wiper for the robot cleaner and including a collection bin 702 and a storage bin 701 arranged in the mounting space S1, the collection bin 702 being configured to receive a dirty wiper, and the storage bin 701 being configured to store a new wiper; the wiper being connected to the robot cleaner and configured to wipe a working surface where the robot cleaner travels; and a garbage collection module, including a dust collection bin 402 and a fan 4 arranged in the mounting space S1, the fan 4 being in communication with the dust collection bin 402 to generate negative pressure in the dust collection bin 402 to draw out garbage stored in the robot cleaner, and the dust collection bin 402 being configured to store the garbage. The base station 100 is capable of providing services of replacing the wiper and collecting the garbage for the robot cleaner 200, thereby reducing manual maintenance.

Figure 11:
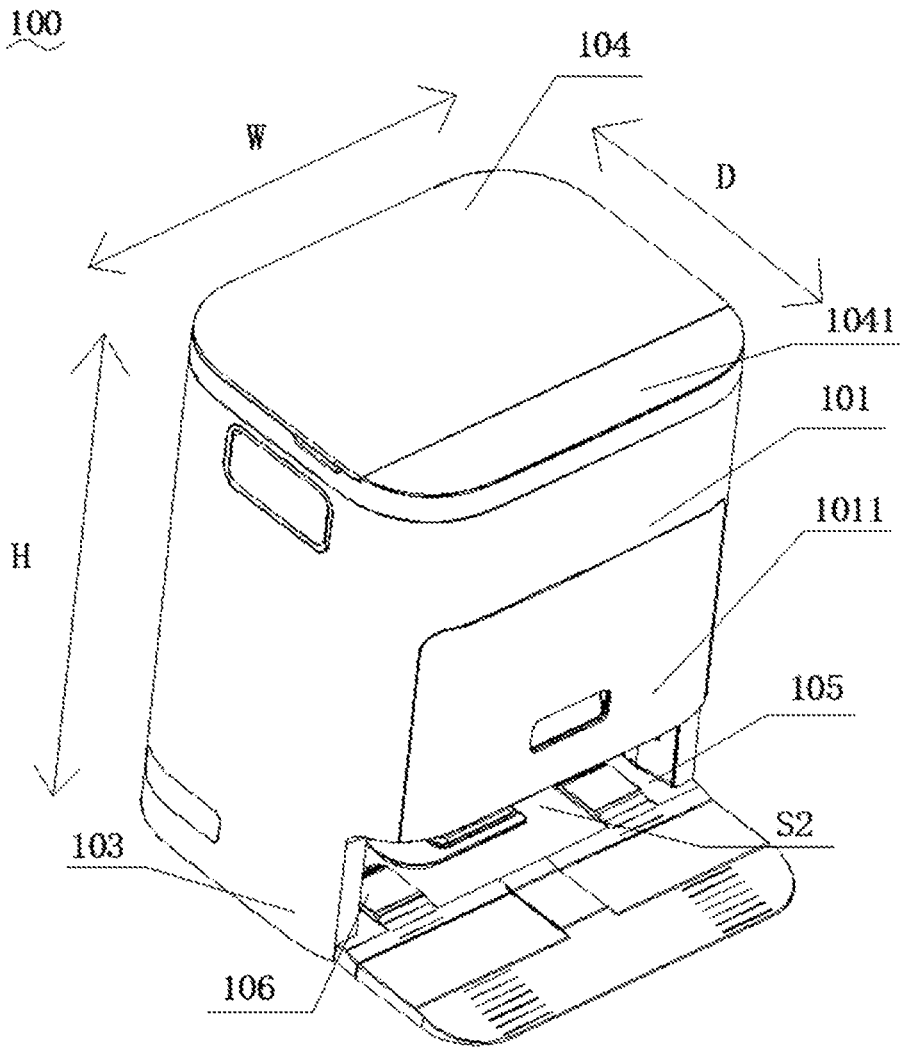
FIG. 11 is a three-dimensional view of a base station according to an embodiment of the disclosure.
Figure 12:
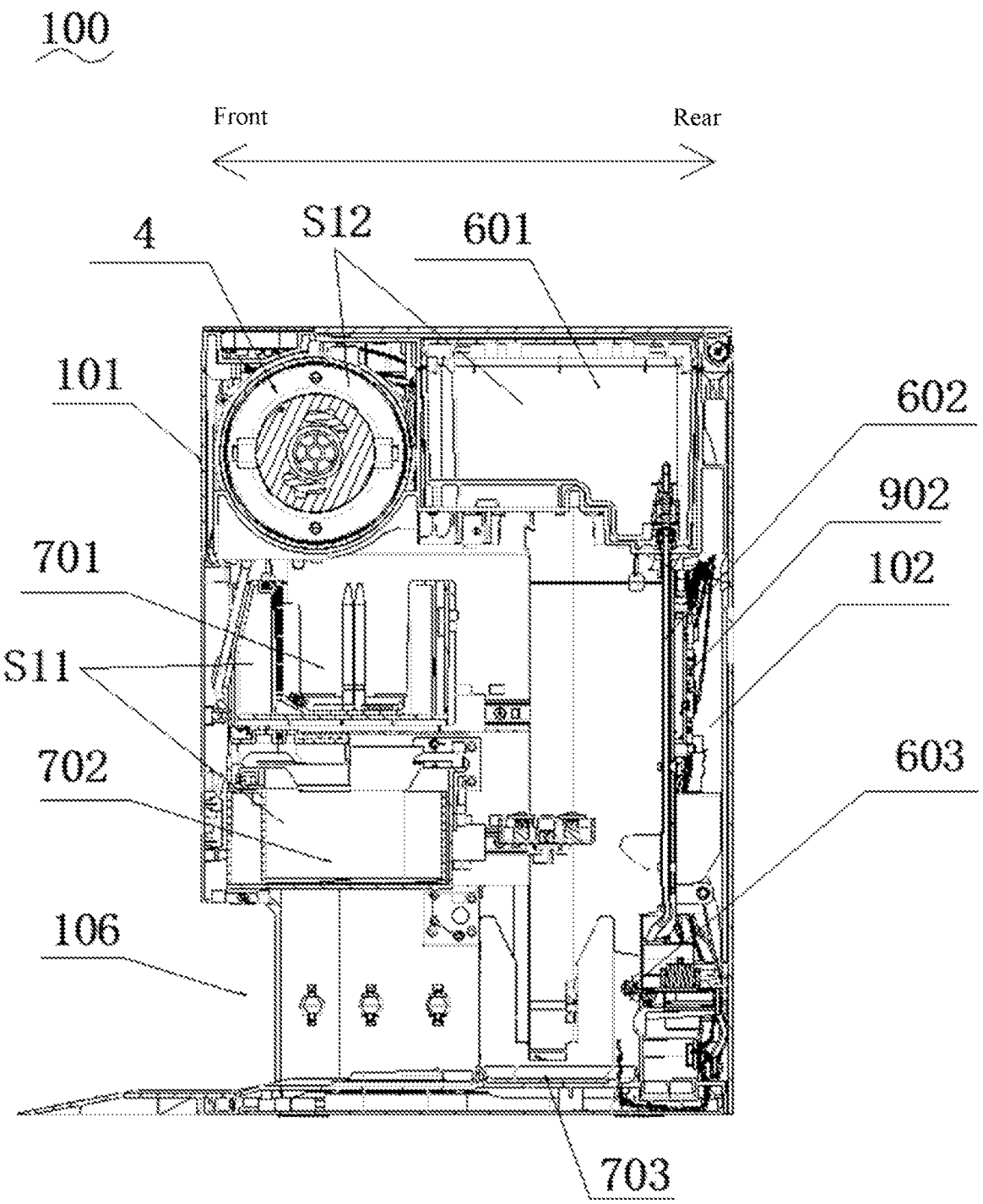
FIG. 12 is a cutaway view of a right side of the base station according to an embodiment of the disclosure.

In one embodiment, referring to FIG. 11 and FIG. 12, the shell has an entrance/exit 106 for at least part of a framework of the robot cleaner 200 to enter or exit the parking space S2. With a direction where the entrance/exit 106 is located as the front, the collection bin 702 and the storage bin 701 are located on a front side or an upper side of the mounting space 51 when in a non-working state. It can be understood that the collection bin 702 and the storage bin 701 being in the non-working state means that the base station 100 does not replace the wiper for the robot cleaner 200, and the collection bin 702 and the storage bin 701 are in a static state with respect to the base station 100. The collection bin 702 and the storage bin 701 are arranged on the front side or the upper side, so that the user can operate the collection bin 702 and the storage bin 701 conveniently, thereby cleaning the dirty wiper in the collection bin 702 and add a new wiper to the storage bin 701. In general cases, the base station is mounted near a wall of a room, so a rear side wall of the base station is close to the wall of the room, and it is not convenient for the user to operate the rear side of the base station. There may be furniture on the left side or the right side of the base station, making it impossible to take out the collection bin or the storage bin from the left side or the right side of the base station. Therefore, the entrance/exit for the robot cleaner to enter and exit is arranged on the front side of the base station. The upper side of the base station is usually not provided with furniture or interference factors either. The front side or the upper side of the base station are usually not blocked. As a result, the collection bin and the storage bin are arranged on the front side or the upper side of the mounting space S1, and thus can be operated and taken out by the user more conveniently. Moreover, there is no waste of space near the base station.

In one embodiment, referring to FIG. 12 to FIG. 13 and FIG. 15 to FIG. 16, the mounting space S1 includes a first accommodating space S11 and a second accommodating space S12.

The second accommodating space S12 is arranged above the first accommodating space S11. The collection bin 702 and the storage bin 701 are arranged in the first accommodating space S11, and the dust collection bin and the fan are arranged in the second accommodating space S12. It can be understood that the second accommodating space S12 being arranged above the first accommodating space S11 means that a plane where the dust collection bin 402 is located and a plane where the fan 4 is located are arranged above a plane where the collection bin 702 is located and a plane where the storage bin 701 is located. Of course, the dust collection bin 402 and the fan 4 may be arranged directly above the collection bin 702 and the storage bin 701, or above the side of the collection bin and the storage bin. The fan 4 and the dust collection bin 402 are reasonably arranged on the upper side of the mounting space S1 and above the collection bin 702 and the storage bin 701, so that the base station 100 is smaller in size in a width direction and a depth direction, occupies smaller floor space and has a more attractive appearance. Moreover, the dust collection bin 402 is arranged on the upper side, so that the user can operate the dust collection bin 402 more conveniently, thereby removing the garbage in the dust collection bin 402.

Further, the robot cleaner includes a wiping plate. The wiper is connected to the wiping plate. The wiper replacement module includes a lifting mechanism arranged at least in the parking space S2 and the first accommodating space S11. The lifting mechanism drives the wiping plate to move between the parking space S2 and the accommodating space S11 to complete the replacement of the wiper on the wiping plate. Since the lifting mechanism needs to drive the wiping plate to move between the parking space S2 and the first accommodating space S11 and there should be no other components along the moving path of the lifting mechanism, the dust collection bin 402 and the fan 4 are arranged above the first accommodating space S11, which avoids affecting the movement of the lifting mechanism and thus makes the layout more reasonable.

Figure 15:
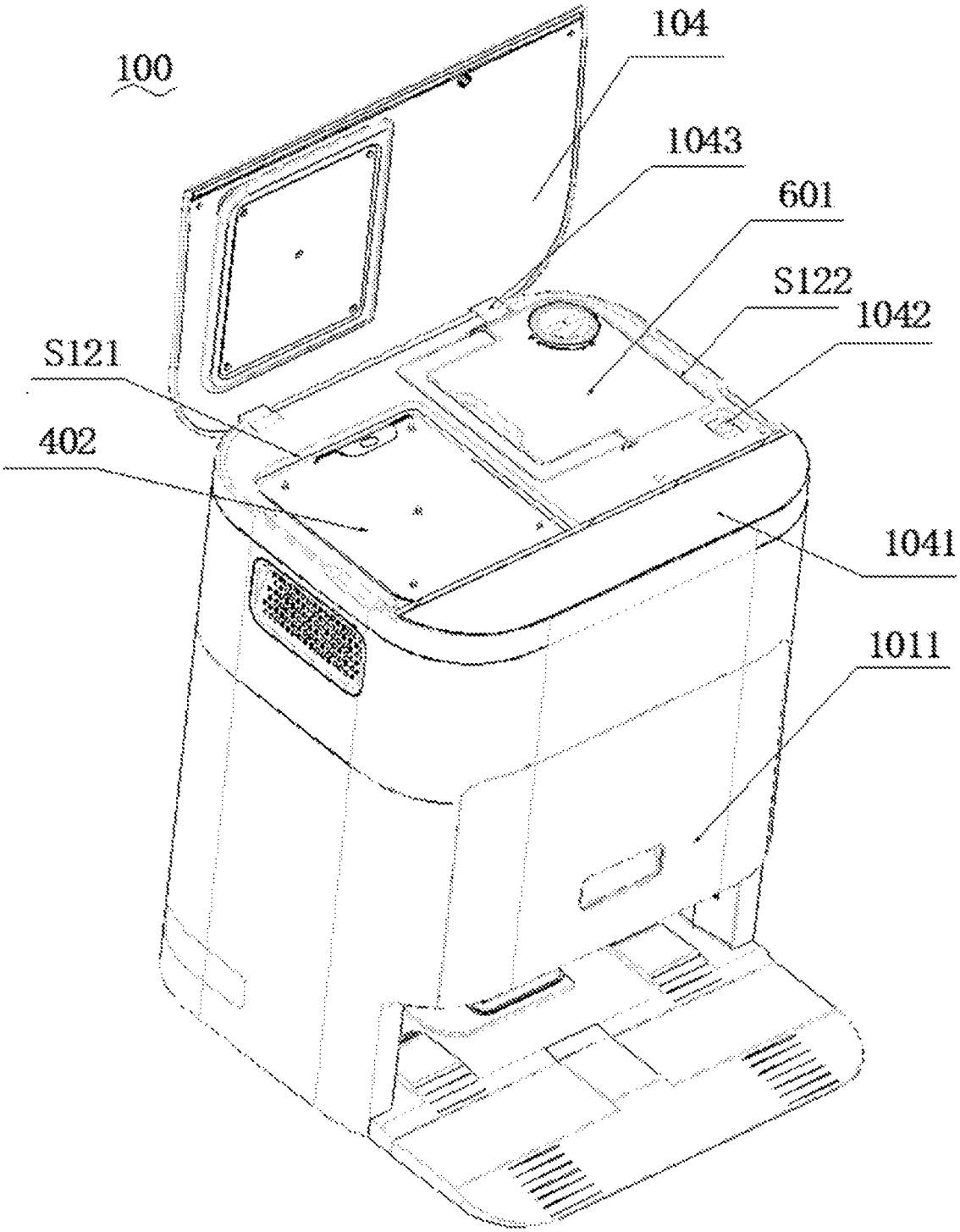
FIG. 15 is a three-dimensional view of the end cover of the base station in a closed state according to an embodiment of the disclosure.
Figure 16:
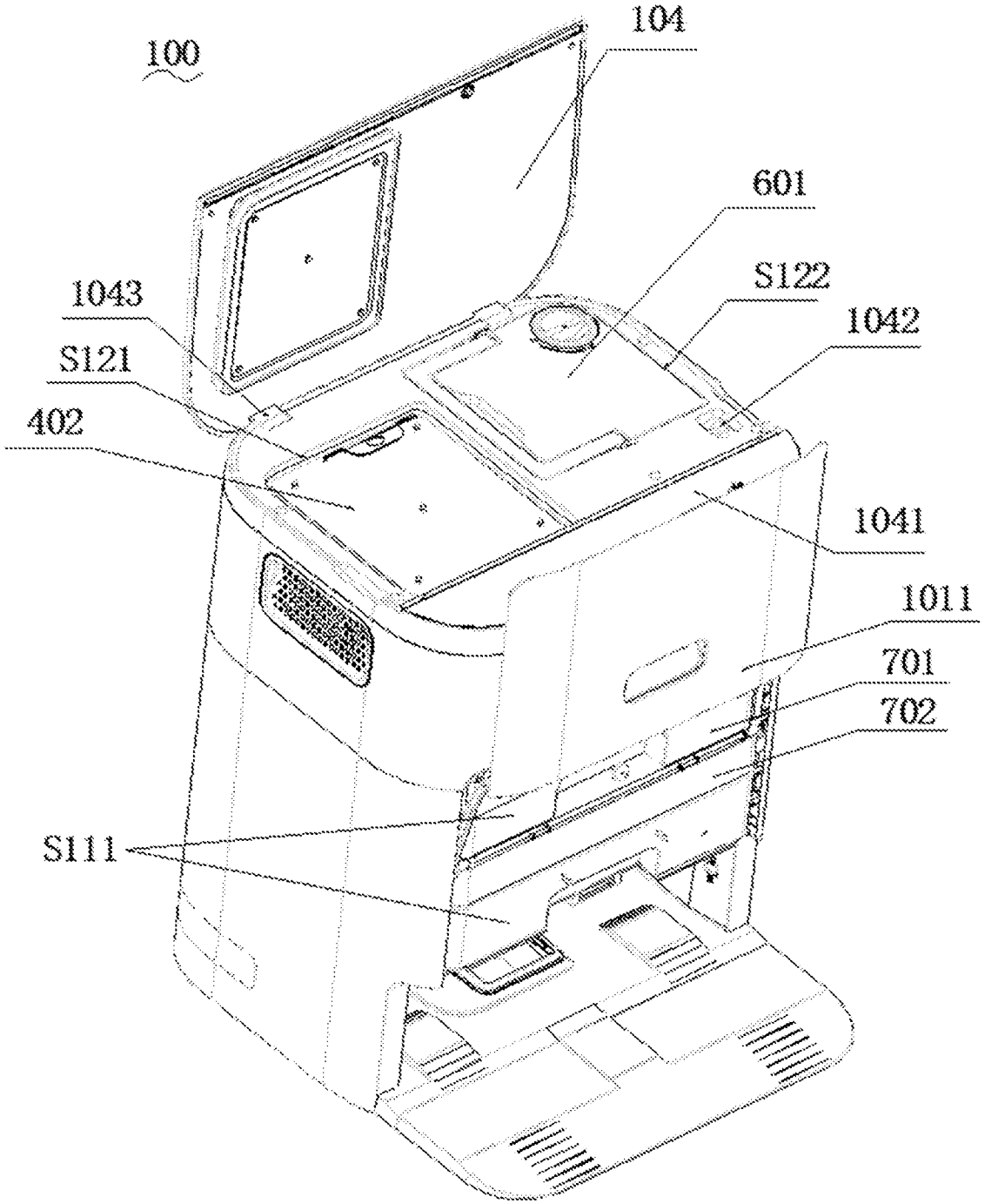
FIG. 16 is a three-dimensional view of the base station with the end cover opened according to an embodiment of the disclosure.

Further, referring to FIG. 12, FIG. 15 and FIG. 16, the collection bin 702 and the storage bin 701 are located at a front side of the first accommodating space S11 when the base station is in a non-working state. The collection bin 702 and the storage bin are detachably connected to the shell. The front side of the first accommodating space S11 has a first opening S111, and the collection bin 702 and the storage bin 701 are capable of being demounted from and mounted into the first accommodating space S11 through the first opening S111. The collection bin 702 and the storage bin 701 are capable of being demounted and mounted through the front side of the first opening S111, which is more convenient for the user to operate. The user may demount the collection bin 702 and the storage bin 701 from the base station 100, dump dirty wipers and fill new wipers, and add new wipers to the storage bin, which avoids getting dirty hands when directly taking out the dirty wipers from the collection bin 702 and is more flexible when adding new wipers.

Further, referring to FIG. 12 to FIG. 13 and FIG. 15 to FIG. 16, the dust collection bin 402 is detachably arranged in the second accommodating space S12. A front side or an upper side of the second accommodating space S12 has a second opening S121, and the dust collection bin is capable of being demounted from and mounted into the second accommodating space S12 through the second opening S121. This facilitates the operation of the user, so that the user can demount the dust collection bin 402 from the base station 100 through the second opening S121 and dump the garbage. Specifically, the dust collection bin 402 includes a non-disposable dust collection box or a disposable or non-disposable dust collection bag. The dust collection bag or the dust collection box is mounted in the mounting space 51, and configured to store garbage in the dust collection bag or the dust collection box and prevent dust from leaking and contaminating components in the base station 100 or the external environment.

In one embodiment, referring to FIG. 11, the base station 100 has a height direction, a width direction W and a depth direction D.

Preferably, in the non-working state, projections of the collection bin 702 and the storage bin 701 in a vertical direction at least partially overlap. Further, the projections of the collection bin 702 and the storage bin 701 in the vertical direction completely overlap. With this arrangement, the collection bin 702 and the storage bin 701 are at least partially or completely located at the same depth and the same width in the base station 100. This avoids the waste of the mounting space 51 in the depth direction D and the width direction W of the base station 100, and reduces the width and depth of the base station 100, thereby making the base station 100 smaller in size.

Figure 13:
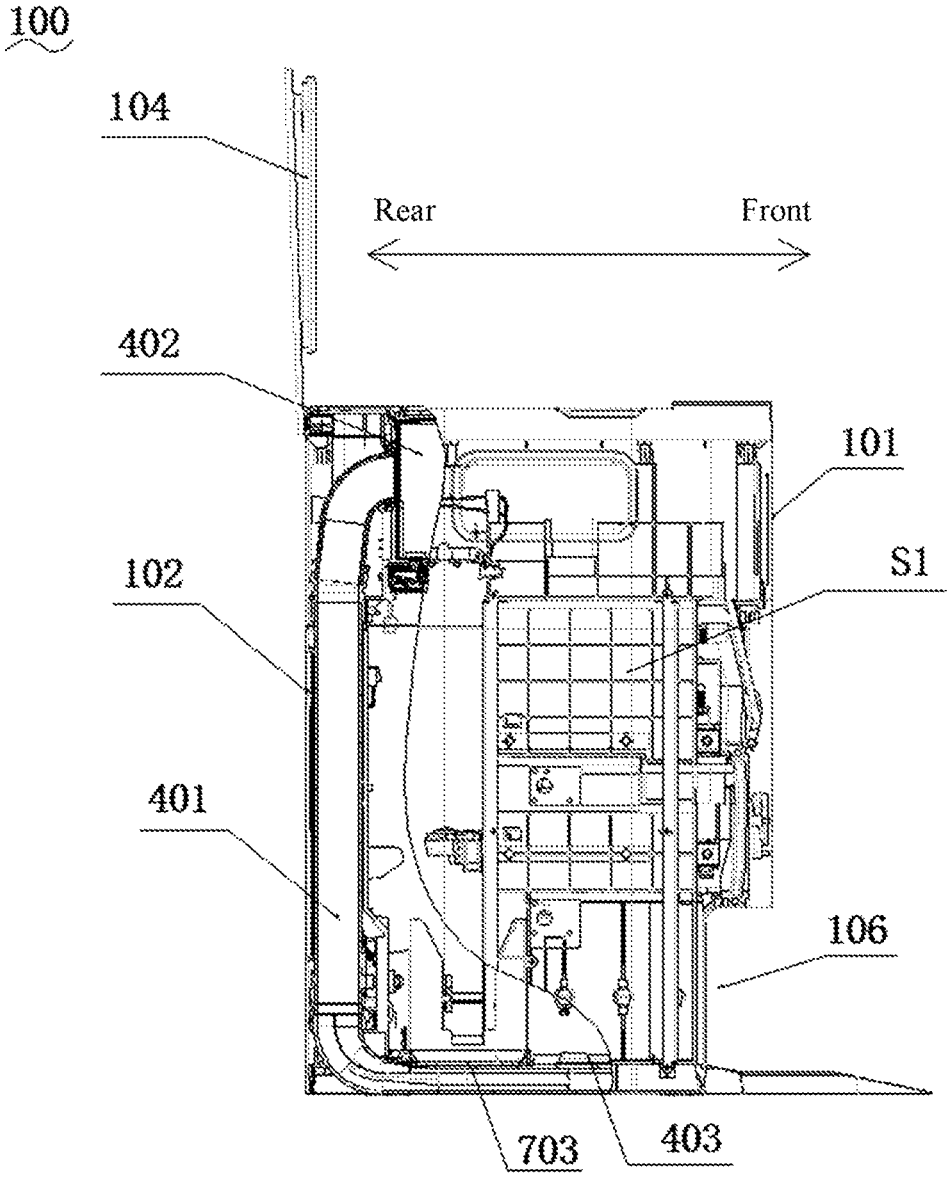
FIG. 13 is a cutaway view of a left side of the base station according to an embodiment of the disclosure.

Preferably, referring to FIG. 12 and FIG. 13, the dust collection bin 402 and the fan 4 are at least partially located at the same height. The dust collection bin 402 and the fan 4 are limited to be on the plane of the same height, which avoids the waste of the mounting space 51 in the height direction H and reduces the height of the base station 100, thereby making the base station 100 further smaller in size. Specifically, top surfaces of the dust collection bin 402 and the fan 4 are located at the same height.

Further preferably, the dust collection bin 402 includes a non-disposable dust collection box or a disposable or non-disposable dust collection bag. A dust inlet of the dust collection bag or the dust collection box is arranged on the side surface. The dust collection bag or the dust collection box is placed horizontally, which reduces the mounting space S1 occupied in the height direction H and further reduces the height of the base station 100. It can be understood that the dust collection bag or the dust collection box has a height, a width and a length corresponding to the height direction H, the width direction W and the depth direction D of the base station, and when the dust collection bag or the dust collection box is placed horizontally, the height is smaller than the width and the length.

In one embodiment, referring to FIG. 12, the base station 100 further includes a liquid adding module, configured to add a liquid to the robot cleaner. The liquid adding module includes a liquid tank configured to store a liquid to be added to the robot cleaner. The liquid tank is arranged in the second accommodating space S12. It can be understood that the liquid tank being arranged in the second accommodating space S12 means that a plane where the liquid tank 601 is located is arranged above a plane where the collection bin 702 is located and a plane where the storage bin 701 is located. Of course, the liquid tank 601 may be arranged directly above the collection bin 702 and the storage bin 701 or above the side of the collection bin and the storage bin. The liquid tank 601 is reasonably arranged on the upper side of the mounting space 51 and above the collection bin 702 and the storage bin 701, so that the base station 100 is smaller in size in the width direction and the depth direction, occupies smaller floor space and has a more attractive appearance. Moreover, the liquid tank 601 is arranged on the upper side, so that the user can operate the liquid tank 601 more conveniently and further add the liquid to the liquid tank 601.

Preferably, referring to FIG. 15, the liquid tank is detachably arranged in the second accommodating space S12. An upper side of the second accommodating space S12 further has a third opening S122, and the liquid tank is capable of being demounted from and mounted into the second accommodating space S12 through the third opening S122. The liquid tank 601 can be demounted and mounted through the third opening S122, which is convenient for the user to operate, so that the user can demount the liquid tank 601 from the base station 100 and add the liquid. It can be understood that the liquid tank 601 may be filled with water, a cleaning liquid, or a mixture of a cleaning liquid and water.

Figure 14:
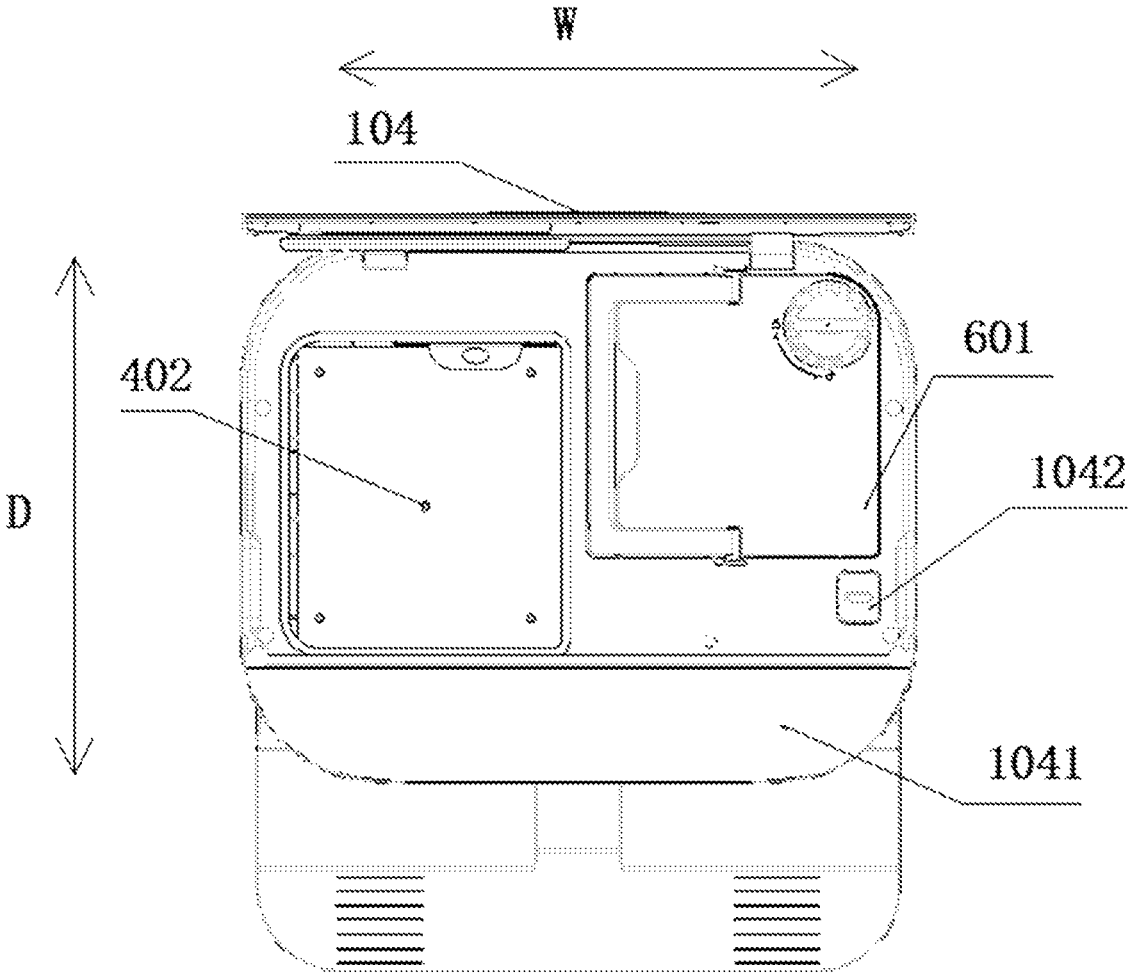
FIG. 14 is a top view of the base station with an end cover opened according to an embodiment of the disclosure.

Preferably, referring to FIG. 12, FIG. 13 and FIG. 14, the dust collection bin 402, the fan 4 and the liquid tank 601 are at least partially located at the same height. The dust collection bin 402, the fan 4 and the liquid tank 601 are limited to be on the plane of the same height, which avoids the waste of the mounting space S1 in the height direction H and reduces the height of the base station 100, thereby making the base station 100 further smaller in size. Further, projections of the liquid tank 601 and the dust collection bin 402 on a surface where a lateral side wall 103 is located at least partially overlap. The liquid tank 601 and the dust collection bin 402 are at least partially located at the same depth of the base station 100. The overlap between the liquid tank 601 and the dust collection bin 402 in the depth direction D avoids the waste of the mounting space S1 in the depth direction D of the base station 100, and reduces the depth of the base station 100. Furthermore, projections of the liquid tank 601 and the fan 4 on a surface where a rear side wall 102 is located at least partially overlap. The liquid tank 601 and the fan 4 are at least partially located at the same width in the base station 100. The overlap between the liquid tank 601 and the fan 4 in the width direction W avoids the waste of the mounting space S1 in the width direction W of the base station 100, and reduces the width of the base station 100.

Figure 18:
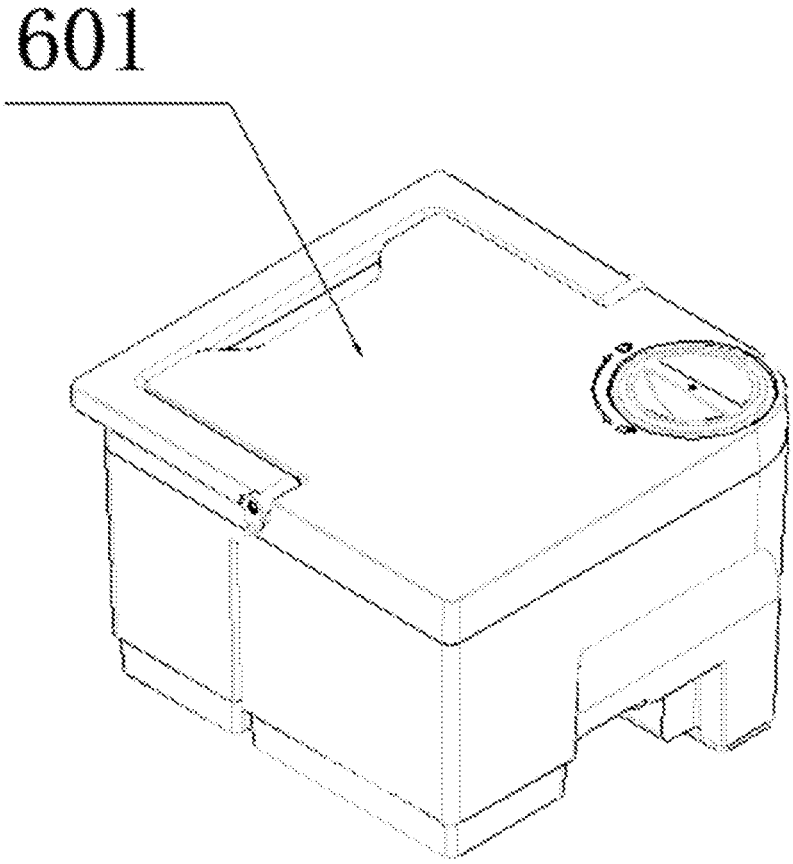
FIG. 18 is a schematic view of a liquid tank of the base station according to an embodiment of the disclosure.

Further, referring to FIG. 18, the liquid tank 601 is of a special-shaped structure. This special-shaped structure is in an irregular shape so as to adapt to the remaining mounting space S1 after the wiper replacement module and the garbage collection module are mounted, which reduces the waste of the mounting space S1 and reduces the base station 100.

In one embodiment, referring to FIG. 15, the base station 100 further includes an interactive panel 1041 for interacting with a user. The interactive panel 1041 is located above the second accommodating space S12. A plane where the interactive panel 1041 is located is located above the plane where the liquid tank 601 is located, the plane where the dust collection bin 402 is located and the plane where the fan 4 is located. The interactive panel 1041 is at least partially exposed from an outer surface of the shell so as to display information of the base station 100 and/or the robot cleaner 200 and to be operated by the user. The interactive panel 1041 is arranged on the upper side, which is convenient for the user to observe and operate.

Further, the dust collection bin 402 includes a dust collection bag. Projections of the dust collection bag and the fan 4 in a vertical direction and a projection of the interactive panel 1041 in the vertical direction at least partially overlap. The fan 4 and the interactive panel 1041 are at least partially located at the same depth of the base station 100, and the dust collection bag and the interactive panel 1041 are at least partially located at the same depth. The overlap between the fan 4 and the interactive panel 1041 and between the dust collection bag and the interactive panel 1041 in the depth direction D avoids the waste of the mounting space S1 in the depth direction D of the base station 100, and reduces the depth of the base station 100, thereby making the base station 100 further smaller in size.

Further, a projection of the liquid tank 601 in a vertical direction and a projection of the interactive panel 1041 in the vertical direction do not overlap. When adding the liquid to the liquid tank 601, the user needs to take out the liquid tank from the upper side of the base station 100. In order to avoid interference of the interactive panel 1041, the liquid tank 601 and the interactive panel 1041 cannot overlap in the width direction W and the depth direction D.

In one embodiment, referring to FIG. 11 to FIG. 13, the shell includes a front side wall 101, a rear side wall 102, an end cover 104 connected to upper parts of the front side wall 101 and the rear side wall 102, a bottom wall 105 at least connected to a lower part of the rear side wall 102, and lateral side walls 103 at least connected to the front side wall 101, the rear side wall 102 and the end cover 104 to form the mounting space S1 and the parking space S2. Furthermore, the bottom wall 105 is connected to the lower parts of the rear side wall 102 and the lateral side walls 103, and the lateral side walls 103 are connected to the front side wall 101, the rear side wall 102, the end cover 104 and the bottom wall 105. The lateral side walls 103 are connected to the front side wall 101, the rear side wall 102, the end cover 104 and the bottom wall 105 to form the mounting space S1, which has a better supporting effect and makes the base station 100 more stable.

Figure 17:
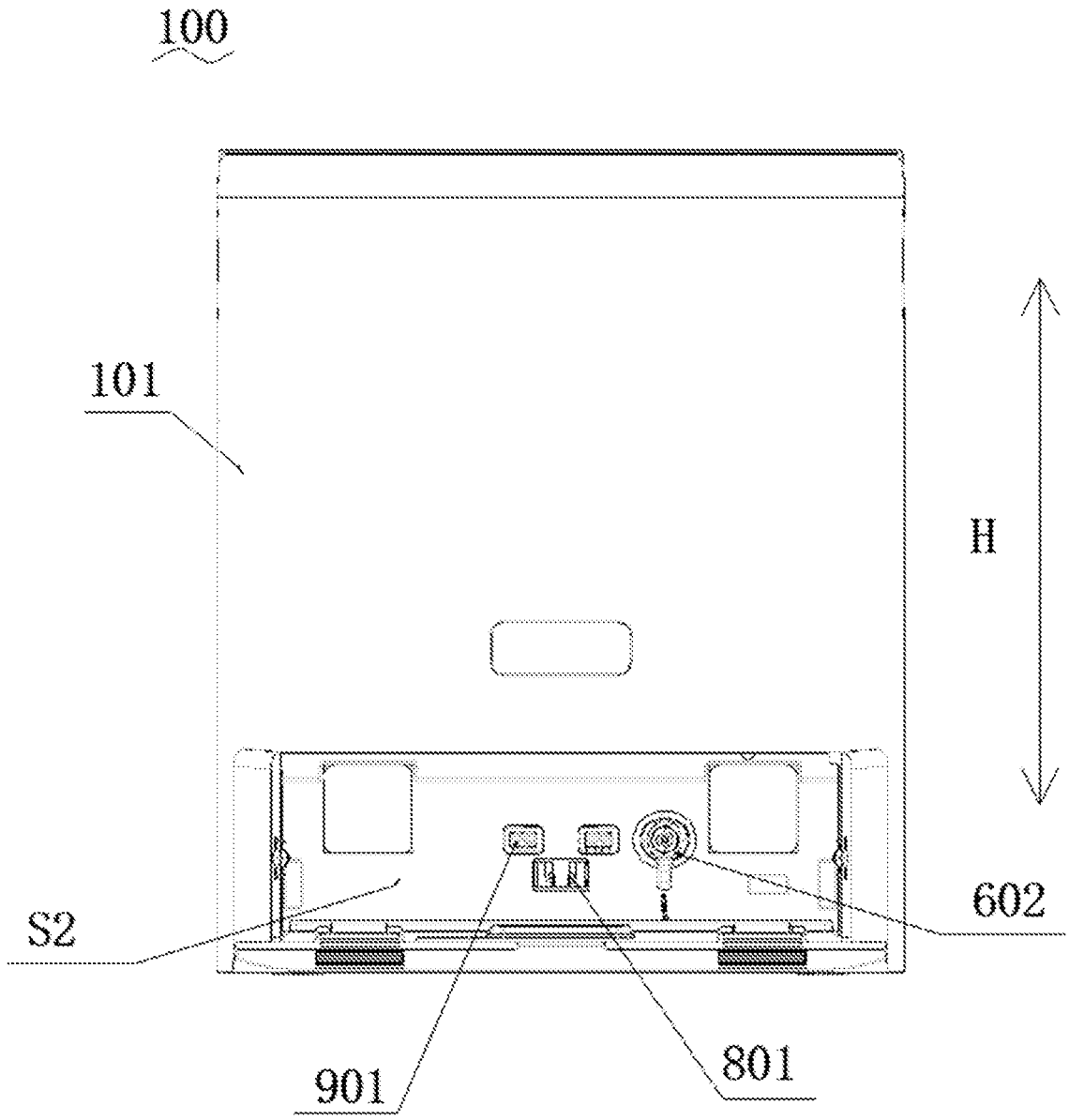
FIG. 17 is a front view of a base station according to an embodiment of the disclosure.

Referring to FIG. 17, the base station 100 further includes a base station infrared sensor 801 configured to be coupled with an infrared sensor on the robot cleaner 200 so as to guide the robot cleaner 200 to park at a maintenance position. The base station 100 maintains the robot cleaner 200 at the maintenance position, and the base station infrared sensor 801 is arranged in the rear side wall 102. The base station infrared sensor 801 is arranged in the rear side wall 102 so as to be coupled with the infrared sensor on the robot cleaner 200.

Referring to FIG. 13, the garbage collection module further includes a dust collection tube 401 in communication with the dust collection bin 402. The dust collection tube 401 is at least partially arranged on a rear side of the mounting space S1. The dust collection tube 401 is configured to guide dust into the dust collection bin 402. Further, the dust collection tube 401 is at least partially arranged inside the rear side wall 102. Since the base station infrared sensor 801 is arranged inside the rear side wall 102 and the base station infrared sensor 801 has a certain depth, the arrangement of the base station infrared sensor inside the rear side wall 102 makes the rear side wall 102 also have a certain thickness. The dust collection tube 401 is arranged in the rear side wall 102, which prevents the dust collection tube 401 from additionally occupying the mounting space 51 and reduces the waste of the space in the base station 100, thereby making the base station 100 smaller in size.

Still referring to FIG. 13, the garbage collection module further includes a docking port 403 in communication with the dust collection tube 401. The docking port 403 docks with the robot cleaner 200 so as to draw garbage stored in the robot cleaner 200. The docking port 403 is arranged in a middle region of the bottom wall 105. The robot cleaner 200 includes a dust box configured to collect garbage on the working surface where the robot cleaner 200 travels. The dust box includes a dust outlet. The dust outlet is arranged in a middle region of a framework of the robot cleaner 200. Specifically, when the base station 100 draws and collects dust from the robot cleaner 200, the dust outlet of the dust box docks with the docking port 403, and the fan 4 generates negative pressure in the dust collection tube 401 and the dust collection bin 402 so as to draw the garbage in the dust box into the dust collection bin 402. The docking port 403 and the dust outlet are cooperatively arranged in the middle region of the base station 100 and the middle region of the framework of the robot cleaner 200 respectively. The docking port 403 is arranged in the middle region of the bottom wall 105 of the base station 100 in cooperation with the dust outlet arranged in the middle region of the framework of the robot cleaner 200, so that the parking space S2 can be adapted to the size of the framework of the robot cleaner 200, which can effectively control the size of the parking space S2, thereby making the base station 100 smaller in size.

Further, the air outlet at the joint between the fan 4 and the dust collection bin 402 is away from the dust inlet at the joint between the dust collection tube 401 and the dust collection bin 402. The dust inlet is arranged on a side surface of the dust collection bag or the dust collection box and close to the rear side wall 102, and the air outlet is arranged on the side surface of the dust collection bag or the dust collection box and close to the front side wall 101. This avoids blocking the dust inlet, so that the garbage can stay in the dust collection bag or the dust collection box. Further, projections of the fan 4 and the dust collection bin 402 on a surface where the lateral side wall 103 is located at least partially overlap. Referring to FIG. 12 and FIG. 13, the fan 4 and the dust collection bin 402 are at least partially located at the same depth of the base station 100. The overlap between the fan 4 and the dust collection bin 402 in the depth direction D avoids the waste of the mounting space S1 in the depth direction D of the base station 100, and reduces the depth of the base station 100, thereby making the base station 100 further smaller in size.

Referring to FIG. 12, the liquid adding module further includes a liquid supply tube 602 in communication with the liquid tank 601. The liquid supply tube 602 is at least partially arranged on the rear side of the mounting space S1. Furthermore, the liquid supply tube 602 is at least partially arranged inside the rear side wall 102. Similarly, the liquid supply tube 602 is arranged in the rear side wall 102, which prevents the liquid supply tube 602 from additionally occupying the mounting space S1 and reduces the waste of the space in the base station 100, thereby making the base station 100 smaller in size.

The liquid adding module further includes a liquid outlet 603 connected to a liquid outlet end of the liquid supply tube 602. The liquid outlet 603 docks with the robot cleaner 200 so as to add the liquid to the robot cleaner 200. The liquid outlet 603 is arranged on the rear side of the mounting space S1. The robot cleaner 200 includes a water tank configured to wet the wiper. The water tank includes a water injection port. The water injection port is arranged on a side surface of the framework. Specifically, the liquid outlet 603 is arranged on the rear side wall 102 and movable within a certain range with respect to the rear side wall 102 so as to accurately dock with the water injection port. The liquid outlet 603 is arranged on the rear side wall 102 in cooperation with the water injection port arranged on the side surface of the framework, thereby making the layout of the liquid outlet 603 more reasonable.

In one embodiment, the base station 100 further includes a circuit board 902. The circuit board 902 has electronic components thereon for realizing various functions of the base station 100, and the circuit board 902 is arranged inside the rear side wall 102. Similarly, the circuit board 902 is arranged in the rear side wall 102 having a certain thickness, which avoids additionally occupying the mounting space S1. Moreover, the circuit board 902 is prevented from being exposed to the outside, which can effectively ensure the safety of the base station 100.

In one embodiment, referring to FIG. 17, the base station 100 includes a base station charging electrode 901 configured to dock with a charging electrode of the robot cleaner 200 so as to charge the robot cleaner 200. The base station charging electrode 901 is arranged on the rear side wall 102. The charging electrode of the robot cleaner 200 is arranged on the side surface of the framework. The base station charging electrode 901 is arranged on the rear side wall 102 in cooperation with the charging electrode of the robot cleaner arranged on the side surface of the framework, thereby making the layout more reasonable.

In one embodiment, referring to FIG. 15 and FIG. 16, the end cover 104 includes a flip structure 1043. The flip structure 1043 is connected to the shell and the end cover 104 such that the end cover 104 flips with respect to the shell to open or close an upper side of the shell, and a projection of the flip structure 1043 on a surface where the bottom wall 105 is located at least partially does not overlap the shell. The flip structure 1043 is partially arranged outside the rear side wall 102, and when the end cover 104 is completely opened, the projection of the end cover 104 on the surface where the bottom wall 105 is located does not overlap the shell. This arrangement can prevent the flip structure 1043 and the end cover 104 from occupying more mounting space 51 in the depth direction D.

In one embodiment, the end cover 104 can be opened or closed with respect to the base station 100. When the end cover 104 is opened, the dust collection bag or the dust collection box can be demounted from or mounted into the second accommodating space S12 from the upper side. When the end cover 104 is closed, the dust collection bag or the dust collection box is concealed inside the base station 100, which prevents the dust collection bag or the dust collection box from being exposed, thereby making the overall base station 100 more attractive and preventing dust from polluting the environment outside the base station 100. Further, when the end cover 104 is opened, the liquid tank 601 can be demounted from or mounted into the second accommodating space S12 from the upper side. When the end cover 104 is closed, the liquid tank 601 is concealed inside the base station 100, which prevents the liquid tank from being exposed, thereby making the overall base station 100 more attractive.

Further, the front side wall 101 includes a front cover 1011. The front cover 1011 can be opened or closed with respect to the base station 100. Referring to FIG. 16, when the front cover 1011 is opened, the collection bin 702 and the storage bin 701 can be demounted from or mounted into the first accommodating space S11 from the front side. Referring to FIG. 15, when the front cover 1011 is closed, the collection bin 702 and the storage bin 701 are concealed inside the base station 100, which prevents the collection bin and the storage bin from being exposed, thereby making the overall base station 100 more attractive.

In one embodiment, referring to FIG. 15 and FIG. 16, the base station 100 further includes a fragrance structure configured to purify air. The fragrance structure is arranged above the fan 4. Specifically, the fragrance structure includes a fragrance box 1042. The fragrance box 1042 is adapted to the remaining mounting space S1 after the fan 4 is mounted. This arrangement can reduce the waste of the mounting space S1 and purify the environment. Specifically, the air flow generated outer inside and outside the base station 100 by the fan 4 volatilizes fragrance in the fragrance box 1042 to the outside of the base station 100.

Figure 19:
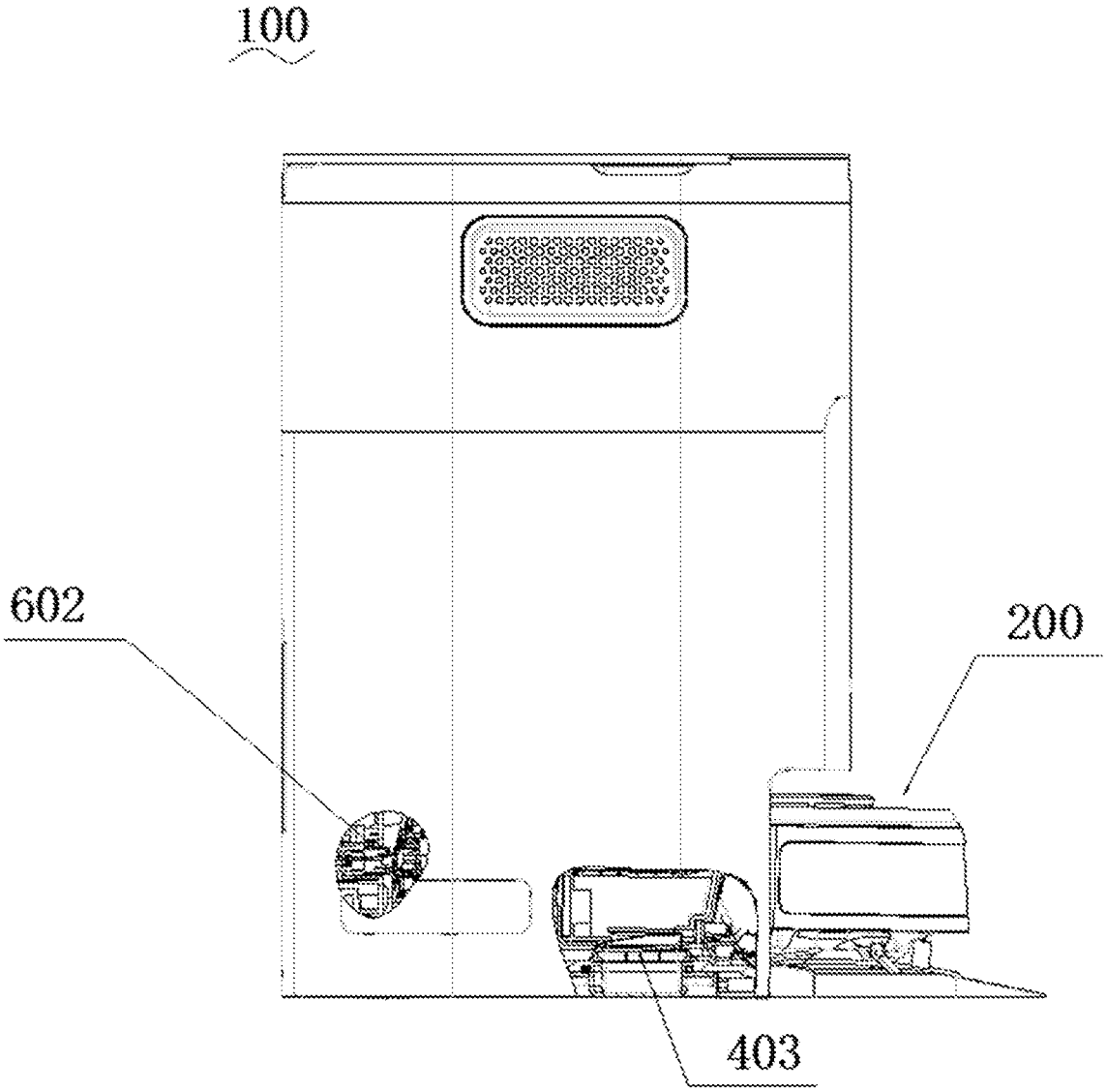
FIG. 19 is a partial cutaway view of the base station docking with the robot cleaner according to an embodiment of the disclosure.
Figure 20:
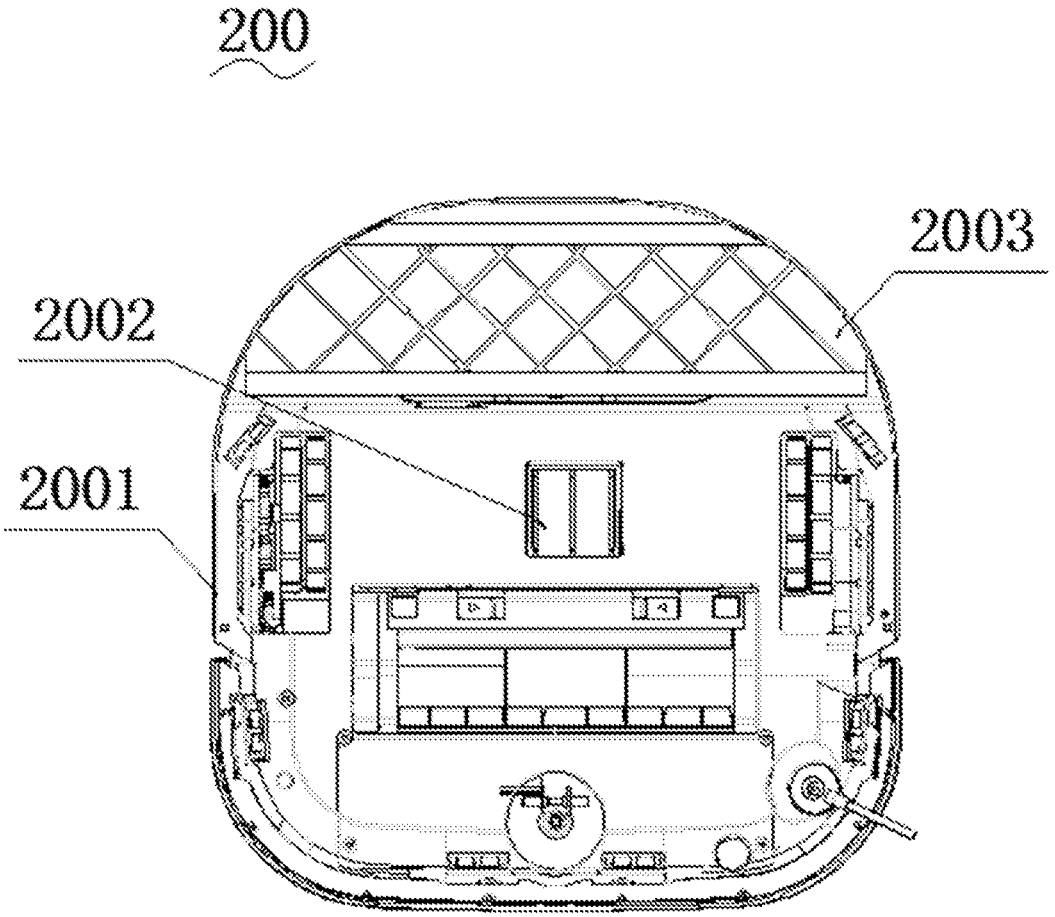
FIG. 20 is a bottom view of the robot cleaner according to an embodiment of the disclosure.
Figure 21:
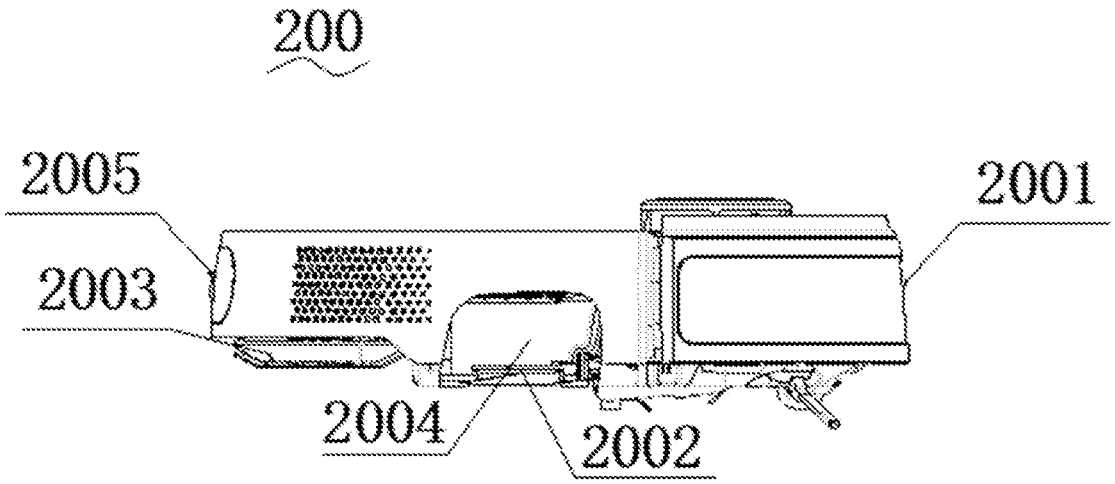
FIG. 21 is a side view and partial cutaway view of the robot cleaner according to an embodiment of the disclosure.

Referring to FIG. 19, FIG. 20 and FIG. 21, the disclosure further provides a robot cleaner 200 system, including a base station 100 in any of the embodiments above and a robot cleaner 200 maintained using the base station 100. The robot cleaner 200 includes: a framework 2001; a wiping plate 2003, arranged on a bottom of the framework 2001, a flexible wiper being replaceably attached to the wiping plate 2003 to form a wiping surface so as to wipe a working surface where the robot cleaner 200 travels; and a dust box 2004, configured to collect garbage on the working surface where the robot cleaner 200 travels.

The dust box 2004 includes a dust outlet 2002. The base station 100 includes a docking port 403. The dust outlet 2002 docks with the docking port 403 such that the base station 100 draws out the garbage in the dust box 2004. Referring to FIG. 19, FIG. 20 and FIG. 21, the dust outlet 2002 is arranged in a middle region of the framework 2001, and the docking port 403 is arranged in a middle region of a bottom wall 105. The docking port 403 is arranged in the middle region of the bottom wall 105 of the base station 100 in cooperation with the dust outlet 2002 arranged in the middle region of the framework 2001, so that the parking space S2 can be adapted to the size of the framework 2001, which can effectively control the size of the parking space S2, thereby making the base station 100 smaller in size.

The robot cleaner 200 includes a water tank configured to wet the wiper. The water tank includes a water injection port. The base station 100 includes a liquid adding module. A liquid outlet 603 of the liquid adding module docks with the water injection port such that the base station 100 adds a liquid to the water tank. The water injection port is arranged on a side surface of the framework 2001 and close to the wiping plate 2003. The liquid outlet 603 is arranged on a rear side wall 102 and can extend out of or retract into an inner surface of the rear side wall 102. The liquid outlet 603 is arranged on the rear side wall 102 in cooperation with the water injection port arranged on the side surface of the framework 2001, thereby making the layout of the liquid outlet 603 more reasonable.

The robot cleaner 200 includes a charging electrode 2005 of the robot cleaner. The base station 100 includes a base station charging electrode 901. The charging electrode 2005 of the robot cleaner is arranged on the side surface of the framework 2001 and close to the wiping plate 2003. The base station charging electrode 901 is arranged on the rear side wall 102. The base station charging electrode 901 is arranged on the rear side wall 102 in cooperation with the charging electrode 2005 of the robot cleaner arranged on the side surface of the framework 2001, thereby making the layout more reasonable.

Referring to FIG. 12 and FIG. 13, when the robot cleaner 200 enters the base station 100 for maintenance, the wiping plate 2003 comes near to the parking space S2 prior to the dust box 2004. The bottom wall 105 is provided with a wiping plate maintenance position 703. The robot cleaner 200 demounts the wiping plate 2003 to the wiping plate maintenance position 703, and remounts the wiping plate 2003 at the wiping plate maintenance position 703. With respect to the front side wall 101 and the rear side wall 102, the wiping plate maintenance position 703 is closer to the rear side wall 102. With an advancing direction of the robot cleaner 200 as the front, the dust box 2004 and the wiping plate 2003 are distributed front and rear with respect to the framework 2001. With respect to the advancing direction of the robot cleaner 200, the robot cleaner 200 retreats into the base station 100 for maintenance.

An infrared sensor of the robot cleaner 200 is arranged at a rear side of the robot cleaner 200 and configured to be coupled with a base station infrared sensor 801. The robot cleaner 200 is guided to enter the base station 100 and properly park at the maintenance position.

The base station 100 may perform wiper replacement, garbage collection, liquid addition and charging for the robot cleaner 200. When the base station 100 performs wiper replacement, garbage collection, liquid addition and charging for the robot cleaner 200, the robot cleaner 200 parks at the same maintenance position of the base station 100. With this arrangement, the docking structures of the base station 100 and the robot cleaner 200 are more simple, and the docking control is also more simple. The above implementations are merely some implementations of the disclosure. Although the description is specific and detailed, but it cannot be understood as limiting the scope of the disclosure. It should be noted that, for those of ordinary skills in the art, several modifications and improvements can be made without departing from the idea of the disclosure. These are modifications and improvements are all within the scope of protection of the disclosure. Therefore, the scope of protection of the disclosure shall be subject to the appended claims.

What is claimed is:

1. A base station configured to maintain a robot cleaner, wherein the base station comprises:

a shell provided with a mounting space and a parking space for the robot cleaner to park;

a wiper replacement module configured to replace a current wiper for the robot cleaner, the wiper replacement module comprising a collection bin and a storage bin arranged in the mounting space, the collection bin configured to receive a dirty wiper, the storage bin configured to store a new wiper, and the current wiper configured to wipe a working surface where the robot cleaner travels when connected to the robot cleaner;

a liquid adding module configured to add a liquid to the robot cleaner and comprising a liquid tank configured to store a liquid to be added to the robot cleaner; and a garbage collection module comprising a dust collection bin and a fan arranged in the mounting space, the fan in communication with the dust collection bin to generate a negative pressure in the dust collection bin to draw out garbage stored in the robot cleaner, and the dust collection bin configured to store the garbage, wherein:

the shell has an entrance/exit for at least part of a framework of the robot cleaner to enter or exit the parking space, and with a direction where the entrance/exit is located as a front, the collection bin and the storage bin are located on a front side or an upper side of the mounting space when the base station is in a non-working state, and the mounting space comprises a first accommodating space and a second accommodating space, the second accommodating space being arranged above the first accommodating space, whereby the collection bin and the storage bin are arranged in the first accommodating space, and the liquid tank, the dust collection bin, and the fan are arranged in the second accommodating space.

2. The base station according to claim 1, wherein the collection bin and the storage bin are located on a front side of the first accommodating space when the base station is in the non-working state.

3. The base station according to claim 2, wherein the collection bin and the storage bin are detachably connected to the shell, the front side of the first accommodating space has a first opening, and the collection bin and the storage bin are capable of being demounted from and mounted into the first accommodating space through the first opening.

4. The base station according to claim 2, wherein the dust collection bin is detachably arranged in the second accommodating space, a front side or an upper side of the second accommodating space has a second opening, and the dust collection bin is capable of being demounted from and mounted into the second accommodating space from the second opening.

5. The base station according to claim 1, wherein the robot cleaner comprises a wiping plate, the current wiper being connected to the wiping plate; and the wiper replacement module comprises a lifting mechanism arranged at least in the parking space and the first accommodating space, the lifting mechanism driving the wiping plate to move between the parking space and the first accommodating space to complete a replacement of the current wiper on the wiping plate.

6. The base station according to claim 1, wherein in the non-working state, projections of the collection bin and the storage bin in a vertical direction at least partially overlap.

7. The base station according to claim 1, wherein the dust collection bin and the fan are at least partially located at a same height.

8. The base station according to claim 1, wherein the liquid adding module further comprises a liquid supply tube configured to transport the liquid in the liquid tank from the second accommodating space to the parking space;

wherein the garbage collection module further comprises a dust collection tube configured to transport the garbage in the robot cleaner from the parking space to the second accommodating space;

wherein the wiper replacement module further comprises a lifting mechanism configured to convey a wiping plate of the robot cleaner between the parking space and the first accommodating space, whereby a path of the lifting mechanism for conveying the wiping plate is located closer to a center of the base station than a path of the liquid supply tube for conveying the liquid and a path of the dust collection tube for conveying the garbage.

9. The base station according to claim 1, wherein the dust collection bin, the fan and the liquid tank are at least partially located at a same height.

10. The base station according to claim 9, wherein the base station further comprises an interactive panel for interacting with a user, the interactive panel located above the second accommodating space.

11. The base station according to claim 10, wherein the dust collection bin comprises a dust collection bag; and projections of the dust collection bag and the fan in a vertical direction and a projection of the interactive panel in the vertical direction at least partially overlap.

12. The base station according to claim 10, wherein a projection of the liquid tank in a vertical direction and a projection of the interactive panel in the vertical direction do not overlap.

13. The base station according to claim 1, wherein the liquid tank is detachably arranged in the second accommodating space, an upper side of the second accommodating space further has a third opening, and the liquid tank is capable of being demounted from and mounted into the second accommodating space from the third opening.

14. The base station according to claim 1, wherein the shell comprises a front side wall, a rear side wall, an end cover connected to upper parts of the front side wall and the rear side wall, a bottom wall at least connected to a lower part of the rear side wall, and lateral side walls at least connected to the front side wall, the rear side wall and the end cover to form the mounting space and the parking space; and the base station further comprises a base station infrared sensor configured to be coupled with an infrared sensor on the robot cleaner so as to guide the robot cleaner to park at a maintenance position, the base station maintains the robot cleaner at a parking position, and the base station infrared sensor is arranged in the rear side wall.

15. The base station to claim 14, wherein the garbage collection module further comprises a dust collection tube in communication with the dust collection bin and configured to guide the garbage into the dust collection bin, the dust collection tube being at least partially arranged in the rear side wall.

16. The base station to claim 14, wherein the liquid adding module further comprises a liquid supply tube in communication with the liquid tank, the liquid supply tube being at least partially arranged in the rear side wall.

17. The base station to claim 14, wherein the end cover comprises a flip structure, the flip structure being connected to the shell and the end cover such that the end cover flips with respect to the shell to open or close an upper side of the shell, and a projection of the flip structure on a surface where the bottom wall is located at least partially not overlapping the shell.

18. A robot cleaner system, comprising a base station according to claim 1 and a robot cleaner maintained by using the base station.

* * * * *